US010257638B2

(12) United States Patent
van Brandenburg et al.

(10) Patent No.: US 10,257,638 B2
(45) Date of Patent: Apr. 9, 2019

(54) AUDIO OBJECT PROCESSING BASED ON SPATIAL LISTENER INFORMATION

(71) Applicant: Koninklijke KPN N.V., The Hague (NL)

(72) Inventors: Ray van Brandenburg, Rotterdam (NL); Arjen Timotheus Veenhuizen, Utrecht (NL); Mattijs Oskar van Deventer, Leidschendam (NL); Lucia D'Acunto, Delft (NL); Emmanuel Didier Rémi Thomas, Delft (NL)

(73) Assignee: Koninklijke KPN N.V., Rotterdam (NL)

( * ) Notice: Subject to any disclaimer, the term of this patent is extended or adjusted under 35 U.S.C. 154(b) by 0 days.

(21) Appl. No.: 15/717,541

(22) Filed: Sep. 27, 2017

(65) Prior Publication Data

US 2018/0098173 A1 Apr. 5, 2018

(30) Foreign Application Priority Data

Sep. 30, 2016 (EP) ..... 16191647

(51) Int. Cl.
*H04S 7/00* (2006.01)
*G10L 19/008* (2013.01)

(52) U.S. Cl.
CPC ..... *H04S 7/303* (2013.01); *G10L 19/008* (2013.01); *H04S 2400/11* (2013.01)

(58) Field of Classification Search
None
See application file for complete search history.

(56) References Cited

U.S. PATENT DOCUMENTS

2009/0262946 A1* 10/2009 Dunko ..... H04S 1/002 381/17
2014/0023197 A1* 1/2014 Xiang ..... H04S 1/007 381/17

(Continued)

FOREIGN PATENT DOCUMENTS

WO 01/55833 A1 8/2001
WO 2009/128859 A1 10/2009
WO 2014/099285 A1 6/2014

OTHER PUBLICATIONS

European Search Report, European Patent Application No. 16191647.3 dated Mar. 3, 2017, 5 pages.

*Primary Examiner* — Curtis A Kuntz
*Assistant Examiner* — Kenny H Truong
(74) *Attorney, Agent, or Firm* — McDonnell Boehnen Hulbert & Berghoff LLP

(57) ABSTRACT

Method for processing audio objects by an audio client apparatus is described wherein the method comprises: receiving or determining spatial listener information, the spatial listener information defining including one or more listener positions, orientations and/or foci of one or more listeners in the audio space; the audio client apparatus selecting one or more audio object identifiers from a set of audio object identifiers defined in a manifest file stored in a memory of the audio client apparatus, an audio object identifier defining an audio object being associated with audio object position information for defining one or more positions of the audio object in the audio space; the selecting of the one or more audio object identifiers by said audio client apparatus being based on the spatial listener information and the audio object position information of audio object identifiers in said manifest file; and, the audio client apparatus using said one or more selected audio object identifiers to request transmission of audio data and audio (Continued)

object metadata associated with the one or more audio objects defined by the selected audio object identifiers to said audio client apparatus.

21 Claims, 10 Drawing Sheets

(56) References Cited

U.S. PATENT DOCUMENTS

2014/0079225 A1 3/2014 Jarske et al.
2015/0332680 A1* 11/2015 Crockett ..... G10L 19/008
381/23

* cited by examiner

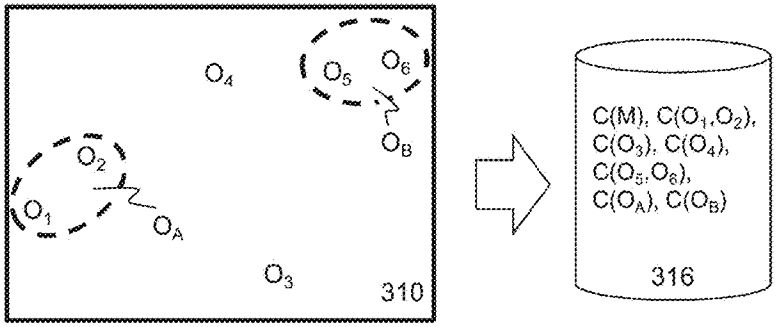

FIG. 3

```
<AudioObjects>
  <AudioObject ID="O1">
    <BaseURL PID="1">http://example.com/movies/movie1/groupA.ts</BaseURL>
      <Position x="10" y="10" z="0"/>
    </AudioObject>
  <AudioObject ID="O2">
    <BaseURL PID="2">http://example.com/movies/movie1/groupA.ts</BaseURL>
    <BaseURL>http://example.com/movies/movie1/O2.wav</BaseURL>
      <Position x="20" y="20" z="0"/>
    </AudioObject>
  <AudioObject ID="O3">
    <BaseURL>http://example.com/movies/movie1/O3.wav</BaseURL>
      <Position x="30" y="5" z="0"/>
    </AudioObject>
  ...
</AudioObjects>
```

$402_1$ $402_2$ 404

FIG. 4

AUDIO OBJECT PROCESSING BASED ON SPATIAL LISTENER INFORMATION

CROSS-REFERENCE TO RELATED APPLICATIONS

The present application claims priority to European Patent Application EP16191647.3, which was filed in the European Patent Office on Sep. 30, 2016, and which hereby incorporated in its entirety herein by reference.

FIELD OF THE INVENTION

The invention relates to audio object processing based on spatial listener information, and, in particular, though not exclusively, to methods and systems for audio object processing based on spatial listener information, an audio client for audio object processing based on spatial listener information, data structures for enabling audio object processing based on spatial listener information and a computer program product for executing such methods.

BACKGROUND OF THE INVENTION

Audio for TV and cinema is typically linear and channel-based. Here, linear means that the audio starts at one point and moves at a constant rate and channel-based means that the audio tracks correspond directly to the loudspeaker positioning. For example, Dolby 5.1 surround sound defines six loudspeakers surrounding the listener and Dolby 22.2 surround sound defines 24channels with loudspeakers surrounding the listener at multiple height levels, enabling a 3D audio effect.

Object-based audio was introduced to decouple production and rendering. Each audio object represents a particular piece of audio content that has a spatial position in a 3D space (hereafter is referred to as the audio space) and other properties such as loudness and content type. Audio content of an audio object associated with a certain position in the audio space will be rendered by a rendering system such that the listener perceives the audio originates from that position in audio space. The same object-based audio can be rendered in any loudspeaker set-up, such as mono, stereo, Dolby 5.1, 7.1, 9.2 or 22.2 or a proprietary speaker system. The audio rendering system knows the loudspeaker set up and renders the audio for each loudspeaker. Audio object positions may be time-variable and audio objects do not need to be point objects, but can have a size and shape.

In certain situations however the number of audio objects can become too large for the available bandwidth of the delivery method. The number of audio objects can be reduced by processing the audio objects before transmission to a client, e.g. by removing or masking audio objects that are perceptually irrelevant and by clustering audio objects into an audio object cluster. Here, an audio object cluster is a single data object comprising audio data and metadata wherein the metadata is an aggregation of the metadata of its audio object components, e.g. the average of spatial positions, dimensions and loudness information.

US 20140079225 A1 describes an approach for efficiently capturing, processing, presenting, and/or associating audio objects with content items and geo-locations. A processing platform may determine a viewpoint of a viewer of at least one content item associated with a geo-location. Further, the processing platform and/or a content provider may determine at least one audio object associated with the at least one content item, the geo-location, or a combination thereof.

Furthermore, the processing platform may process the at least one audio object for rendering one or more elements of the at least one audio object based, at least in part, on the viewpoint.

WO2014099285 describes examples of perception-based clustering of audio objects for rendering object-based audio content. Parameters used for clustering may include position (spatial proximity), width (similarity of the size of the audio objects), loudness and content type (dialog, music, ambient, effects, etc.). All audio objects (possibly compressed), audio object clusters and associated metadata are delivered together in a single data container on the basis of a standard delivery method (Blue-ray, broadcast, 3G or 4G or over-the-top, OTT) to the client.

One problem of the audio object clustering schemes described in WO2014099285 is that the position of the audio objects and audio object clusters are static with respect to the listener position and the listener orientation. The position and orientation of the listener are static and set by the audio producer in the production studio. When generating the audio object metadata, the audio object clusters and the associated metadata are determined relative to the static listener position and orientation (e.g. the position and orientation of a listener in a cinema or home theatre) and thereafter sent in a single data container to the client.

Hence, applications wherein a listener position is dynamic, such as for example an "audio-zoom" function in reality television wherein a listener can zoom into a specified direction or into a specific conversation or an "augmented audio" function wherein a listener is able to "walk around" in a real or virtual world, cannot be realized.

Such applications would require transmitting all individual audio objects for multiple listener positions to the client device without any clustering, thus re-introducing the bandwidth problem. Such scheme would require high bandwidth resources for distributing all audio objects, as well substantial processing power for rendering all audio data at the client side. Alternatively, a real-time, personalized rendering of the required audio objects, object clusters and metadata for a requested listener position may be considered. However, such solution would require a substantial amount of processing power at the server side, as well as a high aggregate bandwidth for the total number of listeners. None of these solutions provide a scalable solution for rendering audio objects on the basis of listener positions and orientations that can change in time and/or determined by the user or another application or party.

Hence, from the above it follows that there is a need in the art for improved methods, server and client devices that enable large groups of listeners to select and consume personalized surround-sound or 3D audio for different listener positions using only a limited amount of processing power and bandwidth.

SUMMARY OF THE INVENTION

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Functions described in this disclosure may be implemented as an algorithm executed by a microprocessor of a computer. Furthermore, aspects of the present invention may take the form of a computer program product embodied in one or more computer readable medium(s) having computer readable program code embodied, e.g., stored, thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber, cable, RF, etc., or any suitable combination of the foregoing. Computer program code for carrying out operations for aspects of the present invention may be written in any combination of one or more programming languages, including an object oriented programming language such as Java™, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor, in particular a microprocessor or central processing unit (CPU), of a general purpose computer, special purpose computer, or other programmable data processing apparatus to produce a machine, such that the instructions, which execute via the processor of the computer, other programmable data processing apparatus, or other devices create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

It is an objective of the invention to reduce or eliminate at least one of the drawbacks known in the prior art. The invention aims to provide an audio rendering system including an audio client apparatus that is configured to render object-based audio data on the basis of spatial listener information. Spatial listener information may include the position and orientation of a listener which may change in time and may be provided the audio client. Alternatively, the spatial listener information may be determined by the audio client or a device associated with the audio client.

In an aspect the invention may relate to a method for processing audio objects comprising: receiving or determining spatial listener information, the spatial listener information including one or more listener positions and/or listener orientations of one or more listeners in a three dimensional (3D) space, the 3D space defining an audio space; receiving a manifest file comprising audio object identifiers, preferably URLs and/or URIs, the audio object identifiers identifying atomic audio objects and one or more aggregated audio objects; wherein an atomic audio object comprises audio data associated with a position in the audio space and an aggregated audio object comprising aggregated audio data of at least a part of the atomic audio objects defined in the manifest file; and, selecting one or more audio object identifiers one the basis of the spatial listener information and audio object position information defined in the manifest file, the audio object position information comprising positions in the audio space of the atomic audio objects defined in the manifest file.

Hence, the invention aims to process audio data on the basis of spatial information about the listener, i.e. spatial listener information such as a listener position or a listener orientation in a 3D space (referred to as the audio space), and spatial information about audio objects, i.e. audio object position information defining positions of audio objects in the audio space. Audio objects may be audio objects as defined in the MPEG-H standards or the MPEG 3D audio standards. Based on the spatial information, audio data may be selected for retrieval as a set of individual atomic audio objects or on the basis of one or more aggregated audio objects wherein the aggregated audio objects comprise aggregated audio data of the set of individual atomic audio objects so that the bandwidth and resources that are required to retrieve and render the audio data can be minimized.

The invention enables an client apparatus to select and requests (combinations of) different types of audio objects, e.g. single (atomic) audio objects and aggregated audio objects such as clustered audio objects (audio object clusters) and multiplexed audio objects. To that end, spatial information regarding the audio objects (e.g. position, dimensions, etc.) and the listener(s) (e.g. position, orientation, etc.) is used.

Here, an atomic audio object may comprise audio data of an audio content associated with one or more positions in the audio space. An atomic audio object may be stored in a separate data container for storage and transmission. For example, audio data of an audio object may be formatted as an elementary stream in an MPEG transport stream, wherein the elementary stream is identified by a Packet Identifier (PID). And, for example, audio data of an audio object may be formatted as an ISOBMFF file.

Information about the audio objects, i.e. audio object metadata, including audio object identifiers and positions of the audio objects in audio space may be provided to the audio client in a data structure, typically referred to as a manifest file. A manifest file may include a list of audio object identifiers, e.g. in the form of URLs or URIs, or information for determining audio object identifiers which can be used by the client apparatus to request audio objects from the network, e.g. one or more audio servers or a content delivery network (CDN). Audio object position information associated with the audio object identifiers may define positions the audio objects in a space (hereafter referred to as the audio space).

The spatial listener information may include positions and/or listener orientations of one or more listeners in the audio space. The client apparatus may be configured to receive or determine spatial listener information. For example, it may receive listener positions associated with video data or a third-party application. Alternatively, a client apparatus may determine spatial listener information on the basis of information from one or more sensors that are configured to sense the position and orientation of a listener, e.g. a GPS sensor for determining a listener position and an accelerometer and/or a magnetic sensor for determining an orientation.

The client apparatus may use the spatial listener information and the audio object position information in order to determine which audio objects to select so that at each listener position a 3D audio listener experience can be achieved without requiring excessive bandwidth and resources.

This way, the audio client apparatus is able to select the most appropriate audio objects as a function of an actual listener position without requiring excessive bandwidth and resources. The invention is scalable and its advantageous effects will become substantial when processing large amounts of audio objects.

The invention enables 3D audio applications with dynamic listener position, such as "audio-zoom" and "augmented audio", without requiring excessive amounts of processing power and bandwidth. Selecting the most appropriate audio objects as a function of listener position also allows several listeners, each being at a distinct listener position, to select and consume personalized surround-sound.

In an embodiment, the selecting of one or more audio object identifiers may further include: selecting an audio object identifier of an aggregated audio object comprising aggregated audio data of two or more atomic audio objects, if the distances, preferably the angular distances, between the two or more atomic audio objects relative to at least one of the one or more listener positions is below a predetermined threshold value. Hence, a client apparatus may use a distance, e.g. the angular distance between audio objects in audio space as determined from the position of the listener to determine which audio objects it should select. Based on the angular separation (angular distance) relative to the listener the audio client may select different (types of) audio objects, e.g. atomic audio objects that are positioned relatively close to the listener and one or more audio object clusters associated with atomic audio objects that are positioned relatively far away from the listener. For example, if the angular distance between atomic audio objects relative to the listener position is below a certain threshold value it may be determined that a listener is not able to spatially distinguish between the atomic audio objects so that these objects may be retrieved and rendered in an aggregated form, e.g. as a clustered audio object.

In an embodiment, the audio object metadata may further comprise aggregation information associated with the one or more aggregated audio objects, the aggregation information signalling the audio client apparatus which atomic audio objects are used for forming the one or more aggregated audio objects defined in the manifest file.

In an embodiment, the one or more aggregated audio objects may include at least one clustered audio object comprising audio data formed on the basis of merging audio data of different atomic audio objects in accordance with a predetermined data processing scheme; and/or a multiplexed audio object formed one the basis of multiplexing audio data of different atomic audio objects.

In an embodiment, audio object metadata may further comprise information at least one of: the size and/or shape, velocity or the directionality of an audio object, the loudness of audio data of an audio object, the amount of audio data associated with an audio object and/or the start time and/or play duration of an audio object.

In an embodiment, the manifest file may further comprise video metadata, the video metadata defining spatial video content associated with the audio objects, the video metadata including: tile stream identifiers, preferably URLs and/or URIs, for identifying tile streams associated with one or more one source videos, a tile stream comprising a temporal sequence of video frames of a subregion of the video frames of the source video, the subregion defining a video tile; and, tile position information.

In an embodiment the method may further comprise: the client apparatus using the video metadata for selecting and requesting transmission of one or more tile streams to the client apparatus; the client apparatus determining the spatial listener information on the basis of the tile position information associated with at least part of the requested tile streams.

In an embodiment the selection and requesting of said one or more audio objects defined by the selected audio object identifiers may be based on a streaming protocol, such as an HTTP adaptive streaming protocol, e.g. an MPEG DASH streaming protocol or a derivative thereof.

In an embodiment, the manifest file may comprise one or more Adaptation Sets, an Adaptation Set being associated with one or more audio objects and/or spatial video content. In a further embodiment, an Adaptation Set may be associated with a plurality of different Representations of the one or more audio objects and/or spatial video content.

In an embodiment, the different Representations of the one or more audio objects and/or spatial video content may include quality representations of an audio and/or video content and/or one or more bandwidth representations of an audio and/or video content.

In an embodiment, the manifest file may comprise: one or more audio spatial relation descriptors, audio SRDs, an audio spatial relation descriptor comprising one or more SRD parameters for defining the position of at least one audio object in audio space.

In an embodiment, a spatial relation descriptor may further comprising an aggregation indicator for signalling the audio client apparatus that an audio object is an aggregated audio object and/or aggregation information for signalling the audio client apparatus which audio objects in the manifest file are used for forming an aggregated audio object.

In an embodiment, an audio spatial relation descriptor SRD may include audio object metadata, including at least one of: information identifying to which audio objects the SRD applies (a source_id attribute), audio object position information regarding the position of an audio object in audio space (object_x, object_y, object_z attributes), aggregation information (aggregation_level, aggregated_objects attributes) for signalling an audio client whether an audio object is an aggregated audio object and—if so—which audio objects are used for forming the aggregated audio object so that the audio client is able determine the level of aggregation the audio object is associated with. For example, a multiplexed audio object formed on the basis of one or more atomic audio objects and a clustered audio object (which again is formed on the basis of a number of atomic audio objects) may be regarded as an aggregated audio object of level 2.

Table 1 provides an exemplary description of these attributes of an audio spatial relation descriptor (SRD) according an embodiment of the invention:

TABLE 1 attributes of the SRD scheme for audio objects

| EssentialProperty@value or SupplementalProperty@value parameter | Description |
|---|---|
| source_id | non-negative integer in decimal representation providing the identifier for the source of the content |

TABLE 1-continued attributes of the SRD scheme for audio objects

| EssentialProperty@value or SupplementalProperty@value parameter | Description |
|---|---|
| object_x | integer in decimal representation expressing the horizontal position of the Audio Object in arbitrary units |
| object_y | integer in decimal representation expressing the vertical position of the Audio Object in arbitrary units |
| object_z | integer in decimal representation expressing the depth position of the Audio Object in arbitrary units |
| spatial_set_id | non-negative integer in decimal representation providing an identifier for a group of audio objects |
| spatial set type | non-negative integer in decimal representation defining a functional relation between audio objects or audio objects and video objects in the MPD that have the same spatial set id. |
| aggregation_level | non-negative integer in decimal representation expressing the aggregation level of the Audio Object. Level greater than 0 means that the Audio Object is the aggregation of other Audio Objects. |
| aggregated_objects | conditional mandatory comma-separated list of AdaptatioSet@id (i.e Audio Objects) that the Audio Object aggregates. When present, the preceding aggregation_level parameter shall be greater than 0. |

In an embodiment, the audio object metadata may include a spatial_set_id attribute. This parameter may be used to group a number of related audio objects, and, optionally, spatial video content such as video tile streams (which may be defined as Adaptation Sets in an MPEG-DASH MPD). The audio object metadata may further include information about the relation between spatial objects, e.g. audio objects and, optionally spatial video (e.g. tiled video content) that have the same spatial_set_id.

In an embodiment, the audio object metadata may comprise a spatial set type attribute for indicating the functional relation between audio objects and, optionally, spatial video objects defined in the MPD. For example, in an embodiment, the spatial set type value may signal the client apparatus that audio objects with the same spatial_set_id may relate to a group of related atomic audio objects for which also an aggregated version exists. In another embodiment, the spatial set type value may signal the client apparatus that spatial video, e.g. a tile stream, may be related to audio that is rendered on the basis of a group of audio objects that have the same spatial set id as the video tile.

In an embodiment, the manifest file may further comprise video metadata, the video metadata defining spatial video content associated with the audio objects.

In a further embodiment, a manifest file may further comprise one or more video spatial relation descriptors, video SRDs, an video spatial relation descriptor comprising one or more SRD parameters for defining the position of at least one spatial video content in a video space. In an embodiment, a video SRD comprise tile position information associated with a tile stream for defining the position of the video tile in the video frames of the source video.

In an embodiment, the method may further comprise: the client apparatus using the video metadata for selecting and requesting transmission of one or more tile streams to the client apparatus; and, the client apparatus determining the spatial listener information on the basis of the tile position information associated with at least part of the requested tile streams.

Hence, the audio space defined by the audio SRD may be used to define a listener location and a listener direction. Similarly, a video space defined by the video SRD may be used to define a viewer position and a viewer direction. Typically, audio and video space are coupled as the listener position/orientation and the viewer position/direction (the direction in which the viewer is watching) may coincide or at least correlate. Hence, a change of the position of the listener/viewer in the video space may cause a change in the position of the listener/viewer in the audio space.

The information in the MPD may allow a user, a viewer/listener, to interact with the video content using e.g. a touch screen based user interface or a gesture-based user interface. For example, a user may interact with a (panorama) video in order "zoom" into an area of the panorama video as if the viewer "moves" towards a certain area in the video picture. Similarly, a user may interact with a video using a "panning" action as if the viewer changes its viewing direction.

The client device (the client apparatus) may use the MPD to request tile streams associated with the user interaction, e.g. zooming or panning. For example, in case of a zooming interaction, a user may select a particular subregion of the panorama video wherein the video content of the selected subregions corresponds to certain tile streams of a spatial video set. The client device may then use the information in the MPD to request the tile streams associated with the selected subregion, process (e.g. decode) the video data of the requested tile streams and form video frames comprising the content of the selected subregion.

Due to the coupling of the video and audio space, the zooming action may change the audio experience of the listener. For example, when watching a panorama video the distance between the atomic audio objects and the viewer/listener may be large so that the viewer/listener is not able to spatially distinguish between spatial audio objects. Hence, in that case, the audio associated with the panorama video may be efficiently transmitted and rendered on the basis of a single or a few aggregated audio objects, e.g. a clustered audio object comprising audio data that is based on a large number of individual (atomic) audio objects.

In contrast, when zooming into a particular subregion of the video (i.e. a particular direction in a video space), the distance between the viewer/listener and one or more audio objects associated with the particular subregion may be small so that the viewer/listener may spatially distinguish between different atomic audio objects. Hence, in that case, the audio may be transmitted and rendered on the basis of one or more atomic audio objects and, optionally, one or more aggregated audio objects.

In an embodiment, the manifest file may further comprise information for correlating the spatial video content with the audio objects. In an embodiment, information for correlating audio objects with the spatial video content may include a spatial group identifier attribute in audio and video SRDs. Further, in an embodiment, an audio SRD may include a spatial group type attribute for signalling the client apparatus a functional relation between audio objects and, optionally, spatial video content defined in the manifest file.

In order to allow a client apparatus to efficiently select audio objects on the basis of spatial video that is rendered, the MPD may include information linking (correlating) spatial video to spatial audio. For example, spatial video objects, such as tiles streams, may be linked with spatial audio objects using the spatial_set_id attribute in the video SRD and audio SRD. To that end, a spatial set type attribute in the audio SRD may be used to signal the client device that the spatial_set_id attribute in the audio and video SRD may be used to link spatial video to spatial audio. In a further embodiment, the spatial set type attribute may be comprised in the video SRD.

Hence, when the client apparatus switches from rendering video on the basis of a first spatial video set to rendering video on the basis of a second spatial video set, the client device may use the spatial_set_id associated with the spatial video sets, e.g. the second spatial video set, in order to efficiently identify a set of audio objects in the MPD that can be used for audio rendering with the video. This scheme is particular advantageous when the amount of audio objects is large.

In an embodiment, the method may further comprise: receiving audio data and audio object metadata of the requested audio objects; and, rendering the audio data into audio signals for a speaker system on the basis of the audio object metadata.

In an embodiment, receiving or determining spatial listener information may include: receiving or determining spatial listener information on the basis of sensor information, the sensor information being generated by one or more sensors configured to determine the position and/or orientation a listener, preferably the one or more sensors including at least one of: one or more accelerometers and/or magnetic sensors for determining an orientation of a listener; one position sensor, e.g. a GPS sensor, for determining a position of a listener.

In an embodiment, the spatial listener information may be static. In an embodiment, the static spatial listener information may include one or more predetermined spatial listening positions and/or listener orientations, optionally, at least part of the static spatial listener information being defined in the manifest file.

In an embodiment, the spatial listener information may be dynamic. In an embodiment, the dynamic spatial listener information may be transmitted to the audio client apparatus. In an embodiment, the manifest file may comprise one or more resource identifiers, e.g. one or more URLs and/or URIs, for identifying a server that is configured to transmit the dynamic spatial listener information to the audio client apparatus.

In an aspect, the invention may relate to a server adapted to generate audio objects comprising: a computer readable storage medium having computer readable program code embodied therewith, and a processor, preferably a microprocessor, coupled to the computer readable storage medium, wherein responsive to executing the first computer readable program code, the processor is configured to perform executable operations comprising: receiving a set of atomic audio objects associated with an audio content, an atomic audio object comprising audio data of an audio content associated with at least one position in the audio space; each of the atomic audio objects being associated with an audio object identifier, preferably (part of) an URL and/or an URI;

receiving audio object position information defining at least one position of each atomic audio object in the set of audio objects, the position being a position in an audio space;

receiving spatial listener information, the spatial listener information including one or more listener positions and/or listener orientations of one or more listeners in the audio space; generating one or more aggregated audio objects on the basis of the audio object position information and the spatial listener information, an aggregated audio object comprising aggregated audio data of at least a part of the set of atomic audio objects; and, generating a manifest file comprising a set of audio object identifiers, the set of audio object identifiers including audio object identifiers for identifying atomic audio objects of the set of atomic audio objects and for identifying the one or more generated aggregated audio objects; the manifest file further comprising aggregation information associated with the one or more aggregated audio objects, the aggregation information signalling an audio client apparatus which atomic audio objects are used for forming the one or more aggregated audio objects defined in the manifest file.

In an embodiment, the invention relates to an client apparatus comprising: a computer readable storage medium having at least part of a program embodied therewith; and, a computer readable storage medium having computer readable program code embodied therewith, and a processor, preferably a microprocessor, coupled to the computer readable storage medium, Wherein the computer readable storage medium comprises a manifest file comprising audio object metadata, including audio object identifiers, preferably URLs and/or URIs, for identifying atomic audio objects and one or more aggregated audio objects; an atomic audio object comprising audio data associated with a position in the audio space and an aggregated audio object comprising aggregated audio data of at least a part of the atomic audio objects defined in the manifest file; and, wherein responsive to executing the computer readable program code, the processor is configured to perform executable operations comprising: receiving or determining spatial listener information, the spatial listener information including one or more listener positions and/or listener orientations of one or more listeners in a three dimensional (3D) space, the 3D space defining an audio space; selecting one or more audio object identifiers one the basis of the spatial listener information and audio object position information defined in the manifest file, the audio object position information comprising positions in the audio space of the atomic audio objects defined in the manifest file; and, using the one or more selected audio object identifiers for requesting transmission of audio data and audio object metadata of the one or more selected audio objects to said audio client apparatus.

The invention further relates to a client apparatus as defined above that is further configured to perform the method according to the various embodiments described above and in the detailed description as the case may be.

In a further aspect, the invention may relate to a non-transitory computer-readable storage media for storing a data structure, preferably a manifest file, for an audio client apparatus, said data structure comprising: audio object metadata, including audio object identifiers, preferably URLs and/or URIs, for signalling a client apparatus atomic audio objects and one or more aggregated audio objects that can be requested; an atomic audio object comprising audio data associated with a position in the audio space and an aggregated audio object comprising aggregated audio data of at least a part of the atomic audio objects defined in the manifest file; audio object position information, for signalling the client apparatus the positions in the audio space of the atomic audio objects defined in the manifest file, and, aggregation information associated with the one or more aggregated audio objects, the aggregation information signalling the audio client apparatus which atomic audio objects are used for forming the one or more aggregated audio objects defined in the manifest file.

In an embodiment, the audio object position information may be included in one or more audio spatial relation descriptors, audio SRDs, an audio spatial relation descriptor comprising one or more SRD parameters for defining the position of at least one audio object in audio space.

In an embodiment, the aggregation information may be included in one or more audio spatial relation descriptors, audio SRDs, the aggregation information including an aggregation indicator for signalling the audio client apparatus that an audio object is an aggregated audio object.

In an embodiment, the non-transitory computer-readable storage media according may further comprise video metadata, the video metadata defining spatial video content associated with the audio objects, the video metadata including: tile stream identifiers, preferably URLs and/or URIs, for identifying tile streams associated with one or more one source videos, a tile stream comprising a temporal sequence of video frames of a subregion of the video frames of the source video, the subregion defining a video tile.

In an embodiment, the tile position information may be included in one or more video spatial relation descriptors, video SRDs, a video spatial relation descriptor comprising one or more SRD parameters for defining the position of at least one spatial video content in video space.

In an embodiment, the one or more audio and/or video SRD parameters may comprise information for correlating audio objects with the spatial video content, preferably the information including a spatial group identifier, and, optionally, a spatial group type attribute.

The invention may also relate to a computer program product comprising software code portions configured for, when run in the memory of a computer, executing the method steps as described above.

The invention will be further illustrated with reference to the attached drawings, which schematically will show embodiments according to the invention. It will be understood that the invention is not in any way restricted to these specific embodiments.

BRIEF DESCRIPTION OF THE DRAWINGS

FIG. 3 depicts audio objects according to an embodiment of the invention.

FIG. 4 depicts a schematic of part of a manifest file according to an embodiment of the invention.

DETAILED DESCRIPTION

Figure 1A:
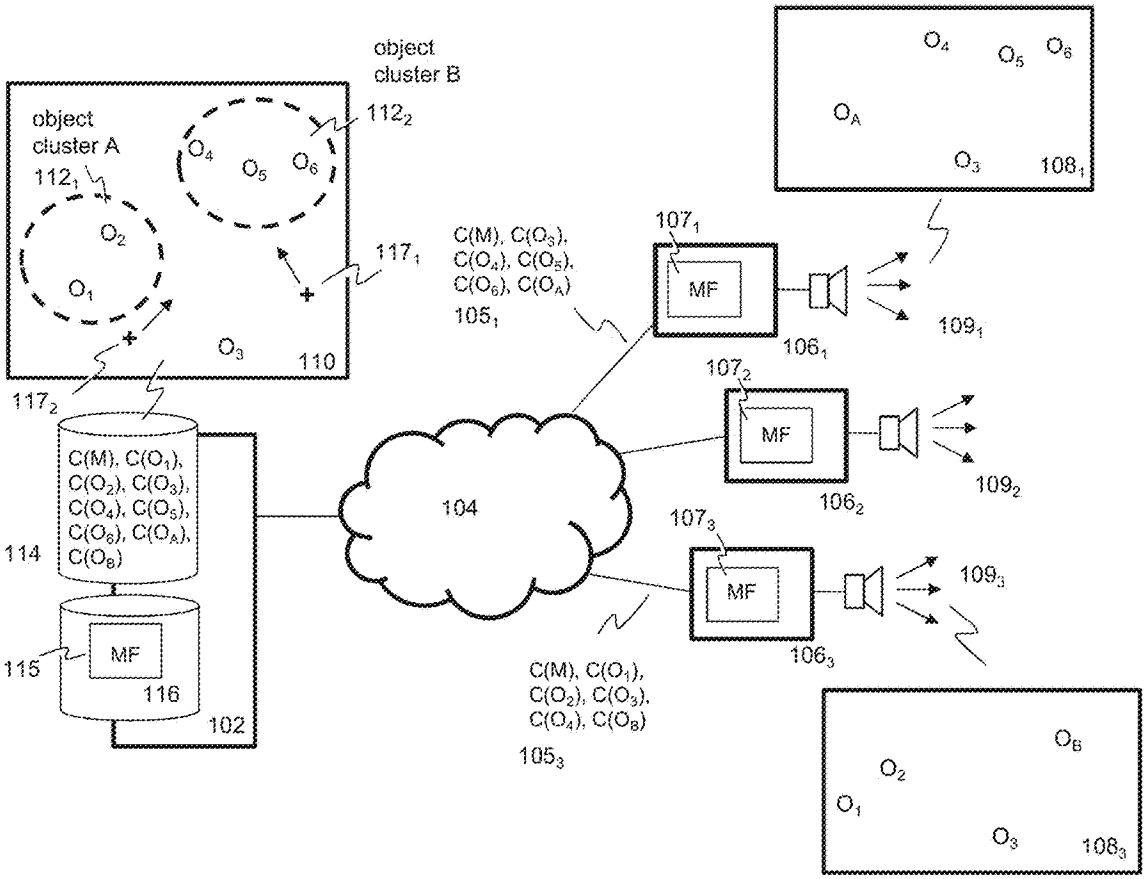
FIG. 1A-1C depict schematics of an audio system for processing object-based audio according to an embodiment of the invention.
Figure 1C:
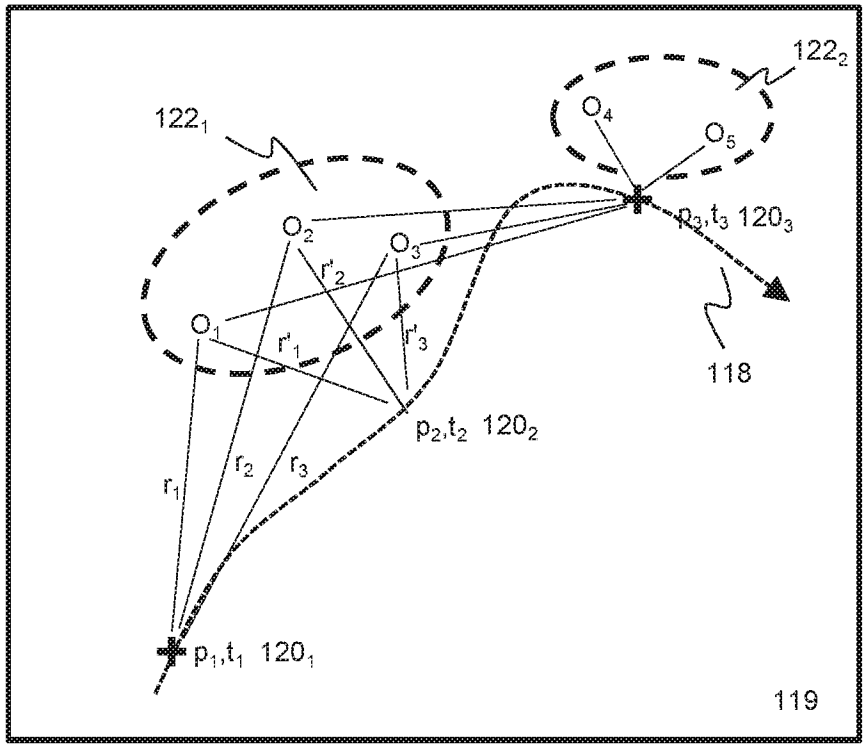
Figure 1B:
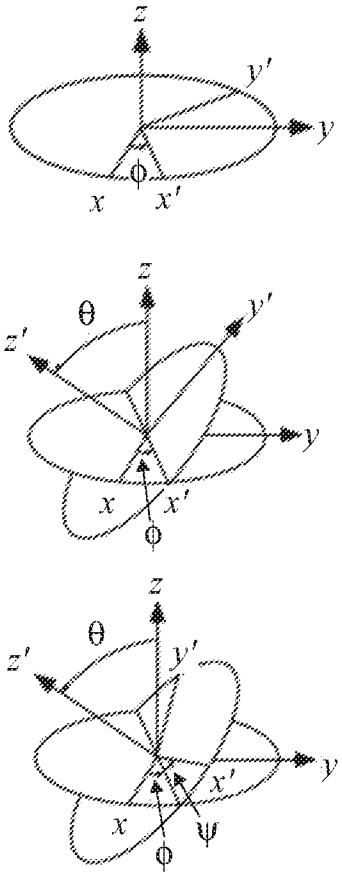

FIG. 1A-1C depict schematics of an audio system for processing object-based audio according to various embodiments of the invention. In particular, FIG. 1A depicts an audio system comprising one or more audio servers 102 and one or more audio client devices (client apparatuses) $\mathbf{106}_{1\text{-}3}$ that are configured to communicate with the one or more servers via one or more networks 104. The one or more audio servers may be configured to generate audio objects. Audio objects provide a spatial description of audio data, including parameters such as the audio source position (using e.g. 3D coordinates) in a multi-dimensional space (e.g. 2D or 3D space), audio source dimensions, audio source directionality, etc. The space in which audio objects are located is hereafter referred to as the audio space. A single audio object comprising audio data, typically a mono audio channel, associated with a certain location in audio space and stored in a single data container may be referred to as an atomic audio object. The data container is configured such that each atomic audio object can be individually accessed by an audio client.

For example, in FIG. 1A, the audio server may generate or receive a number of atomic audio objects $O_1$-$O_6$ wherein each atomic audio object may be associated with a position in audio space. For example, in case of a music orchestra, atomic audio objects may represent audio data associated with different spatial audio content, e.g. different music instruments that have a specific position within the orchestra. This way, the audio of the orchestra may comprise separate atomic audio objects for the string, brass, woodwind, and percussion sections.

In some situations, the angular distance between different atomic audio objects relative to the listener position may be small. In that case, the atomic audio objects are in close spatial proximity relative to the listener position so that a listener will not be able to spatially distinguish between individual atomic audio objects. In that case, efficiency can be gained by enabling the audio client to select those atomic audio objects in an aggregated form, i.e. as a so-called aggregated audio object.

To that end, a server may prepare or generate (real-time or in advance) one or more aggregated audio objects on the basis of a number of atomic audio object. An aggregated audio object is a single audio object comprising audio data of multiple audio objects, e.g. multiple atomic audio objects and/or aggregated audio objects, in a one data container.

Hence, the audio data and metadata of an aggregated audio object are based on the audio data and the metadata of different audio objects that are used during the aggregation process. Different type of aggregation processes, include clustering and/or multiplexing, may be used to generate an aggregated audio object.

For example, in an embodiment, audio data and metadata of audio objects may be aggregated by combining (clustering) the audio data and metadata of the individual audio objects. The combined (clustered) result, i.e. audio data and, optionally, metadata, may be stored in a single data container. Here, combining audio data of different audio objects may include processing the audio data of the different audio objects on the basis of a number of data operations, resulting in a reduced amount of audio data and metadata when compared to the amount of audio data and metadata of the audio objects that were using in the aggregation process.

For example, audio data of different atomic audio objects may be decoded, summed, averaged, compressed, re-encoded, etc. and the result (the aggregated audio data) may be stored in a data container. In an embodiment, (part of the) metadata may be stored with the audio data in a single data container. In another embodiment, (part of the) metadata and the audio data may be stored in separate data containers. The audio object comprising the combined data may be referred to as an audio object cluster.

In another embodiment, audio data and, optionally metadata, of one or more atomic audio objects and/or one or more aggregated audio objects (such as an audio object clusters) may be multiplexed and stored in a single data container. An audio object comprising multiplexed data of multiple audio objects may be referred to as a multiplexed audio object. Unlike with an audio object cluster, individual (possibly atomic) audio objects can still be distinguished within a multiplexed audio object.

A spatial audio map 110 illustrates the spatial position of the audio objects at a predetermined time instance in audio space, an 2D or 3D space defined by suitable coordinate system. In an embodiment, audio objects may have fixed positions in audio space. In another embodiment, (at least part of the) audio objects may move in audio space. In that case, the positions of audio objects may change in time.

Hence, as will be described hereunder in more detail, different types of audio objects exist, for example a (single) atomic audio object, a cluster of atomic audio objects (an audio object cluster) or a multiplexed audio object (i.e. an audio object in which the audio data of two or more atomic audio objects and/or audio object clusters are stored in a data container in a multiplexed form). The term audio object may refer to any of these specific audio object types.

Typically, an listener (a person listening to audio in audio space) may use an audio system as shown in FIG. 1A. An audio client (client apparatus), e.g. $\mathbf{106}_1$ may be used for requesting and receiving audio data of audio objects from an audio server. The audio data may be processed (e.g. extracted from a data container, decoded, etc.) and a speaker system, e.g. $\mathbf{109}_1$, may be used for generating an spatial (3D) audio experience for the listener on the basis of requested audio objects.

In embodiments, the audio experience for the audio listener depends on the position and orientation of the audio listener relative to the audio objects wherein the listener position can change in time. Therefore, the audio client is adapted to receive or determine spatial listener information that may include the position and orientation of the listener in the audio space. For example, in an embodiment, an audio client executed on a mobile device of an listener may be configured to determine a location and orientation of the listener using one or more sensors of the mobile device, e.g. a GPS sensor, a magnetic sensor, an accelerometer or a combination thereof.

The spatial audio map 110 in FIG. 1A illustrates the spatial layout in audio space of a first listener $\mathbf{117}_1$ and second listener $\mathbf{117}_2$. The first listener position may be associated with the first audio client $\mathbf{106}_1$, while the second listener position may be associated with third audio client $\mathbf{106}_3$.

The audio server of the audio system may generate two object clusters $O_A$ and $O_B$ on the basis of the positions of the atomic audio objects and spatial listener information associated with two listeners at position $\mathbf{117}_1$ and $\mathbf{117}_2$ respectively. For example, the audio server may determine that the angular distance between atomic audio objects $O_1$ and $O_2$ as determined relative to the first listener position 117$_1$ is relatively small. Hence, as the first listener will not be able to individually distinguish between atomic audio objects 1 and 2, the audio sever will generate object cluster A 112$_1$ that is based on the first and second atomic audio object $O_{1,2}$. Similarly, because of the small angular distance between atomic audio objects $O_4$, $O_1$ and $O_1$ relative to the second listener position 117$_2$, the audio server may decide to generate cluster B 112$_2$ that is based on the individual audio objects 4, 5 an 6. Each of generated aggregated audio objects and atomic audio objects may be stored in its own data container C in a data storage, e.g. audio database 114. At least part of the metadata associated with the aggregated audio objects may be stored together stored with the audio data in the data container. Alternatively and/or in addition, audio object metadata M associated with aggregated audio objects may be stored separately from the audio objects in a data container. The audio object metadata may include information which atomic audio objects are used during the clustering process.

Additionally, the audio server may be configured to generate one or more data structures generally referred to as manifest files (MFs) 115 that may contain audio object identifiers, e.g. in the form of (part of) an HTTP URI, for identifying audio object audio data or metadata files and/or streams. A manifest file may be stored in a manifest file database 116 and used by an audio client in order request an audio server transmission of audio data of one or more audio objects. In a manifest file, audio object identifiers may be associated with audio object metadata, including audio object positioning information for signalling an audio client device at least one position in audio space of the audio objects defined in the manifest file.

Audio objects and audio object metadata that may be individually retrieved by the audio client may be identified in the manifest file using URLs or URIs. Depending on the application however other identifier formats and/or information may be used, e.g. (part of) an (IP) address (multicast or unicast), frequencies, or combinations thereof. Examples of manifest files will be described hereunder in more detail. In an embodiment, the audio object metadata in the manifest file may comprise further information, e.g. start, stop and/or length of an audio data file of an audio object, type of data container, etc.

Hence, an audio client (also referred to as client apparatus) 106$_{1\text{-}3}$ may use the audio object identifiers in the manifest file 107$_{1\text{-}3}$, the audio objects position information and the spatial listener information in order to select and request one or more audio servers to transmit audio data of selected audio objects to the audio client device.

As shown by the audio map in FIG. 1A, the angular distance between audio objects $O_3$-$O_6$ relative to the first listener position 117$_1$ may be relatively large so the first audio client may decide to retrieve these audio objects as separate atomic audio objects. Further, the angular distance between audio objects $O_1$ and $O_2$ relative to the first listener position 117$_1$ may be relatively small so that the first audio client may decide to retrieve these audio objects as an aggregated audio object, audio object cluster $O_A$ 112$_1$. In response to the request of the audio client, the server may send the audio data and metadata associated with the requested set 105$_1$ of audio objects and audio object metadata to the audio client (here a data container is indicated by "C(. .)"). The audio client may process (e.g. decode) and render the audio data associated with the requested audio objects.

In a similar way, as the angular distance between audio objects $O_4$,$O_5$,$O_6$ relative to the second listener position 117$_2$ is relatively small and the angular distance between audio objects $O_1$,$O_2$,$O_3$ relatively large, the audio client may decide to request audio objects $O_1$-$O_3$ as individual atomic audio objects and audio objects $O_4$-$O_6$ as a single aggregated audio object, audio object cluster $O_B$.

Thus instead of requesting all individual atomic audio object, the invention allows requesting either atomic audio objects or aggregated audio objects on the basis of locations of the atomic audio objects and the spatial listener information such as the listener position. This way, an audio client or a server application is able to decide not to request certain atomic audio objects as individual audio objects, each having its own data container, but in an aggregated form, an aggregated audio object that is composed of the atomic audio objects. This way the amount of data processing and bandwidth that is needed in order to render the audio data as spatial 3D audio.

The embodiments in this disclosure, such as the audio system of FIG. 1A, thus allow efficient retrieval, processing and rendering of audio data by an audio client based on spatial information about the audio objects and the audio listeners in audio space. For example, audio objects having a large angular distance relative to the listener position may be selected, retrieved and processed as individual atomic audio objects, whereas audio objects having a small angular distance relative to the listener position may be selected, retrieved and processed as an aggregated audio object such as an audio cluster or a multiplexed audio cluster. This way, the invention is able to reduce bandwidth usage and required processing power of the audio clients. Moreover, the positions of the audio objects and/or listener(s) may be dynamic, i.e. change on the basis of one or more parameters, e.g. time, enabling advanced audio rendering functions such as augmented audio.

In addition to the position of an audio listener, the orientation of the listeners may also be used to select and retrieve audio object. A listener orientation may e.g. define a higher audio resolution for a first listener orientation (e.g. positions in front of the listener) when compared with a second listener orientation (e.g. positions behind the listener). For example, a listener facing a certain audio source, e.g. an orchestra, will experience the audio differently when compared with a listener that is turned away from the audio source.

An listener orientation may be expressed as a direction in 3D space (schematically represented by the arrows at listener positions 117$_{1,2}$) wherein the direction represents the direction(s) a listener is listening. The listener orientation is thus dependent on the orientation of the head of the listener. The listener orientation may have three angles ($\phi$,$\Theta$,$\psi$) in an Euler angle coordinate system as shown in FIG. 1B. A listener may have his head turned at angles ($\phi$,$\Theta$,$\psi$) relative to the x, y and z axis. The listener orientation may cause an audio client to decide to select an aggregated audio object instead of the individual atomic audio objects, even when certain audio objects are positioned close to the listener, e.g. when the audio client determines that the listener is turned away from the audio objects.

FIG. 1C depicts a schematic representing a listener moving along a trajectory 118 in the audio space 119 in which a number of audio objects $O_1$-$O_6$ are located. Each point on the trajectory may be identified by a listener position P, orientation O and time instance T. At a first time instance T1, the listener position is P1. At that position P1 120$_1$, the angular distances between a group audio objects $O_1$-$O_3$ $122_1$, is relatively small so that the audio client may request these audio objects in an aggregated form. Then, when moving along the trajectory to position P2 $120_2$ at time instance T2, the listener may have moved towards the audio objects position resulting in relatively large angular distances between the audio objects $O_1$-$O_3$. Therefore, at that position the audio client may request the individual atomic audio objects.

Then, as the listener moves further along the trajectory up to point P3 $120_3$ at time instance T3, the listener has moved away from audio objects $O_1$-$O_3$ and moving relatively close to further group of audio objects $O_4$,$O_5$ $122_2$ (which were not audible at P1 and P2). Therefore, at that position the audio client may request audio objects $O_1$-$O_3$ in aggregated form and audio objects $O_4$ and $O_5$ as individual atomic audio objects.

In addition to the positions along the trajectory, the audio client may also take the listener orientation (e.g. in terms of Euler angles or the like) when deciding to select between individual atomic audio objects or one or more aggregated objects that are based on the atomic audio objects.

More generally, the embodiments in this disclosure aim to provide audio objects, in particular different types of audio objects (e.g. atomic, clustered and multiplexed audio objects), at different positions in audio space that can be selected by an audio client using spatial listener information.

Additionally, the audio client may select audio objects on the basis of the rendering possibilities of the audio client. For example, in an embodiment, an audio client may select more object clustering for an audio system like headphones, when compared with a 22.2 audio set-up.

For example, in case of an orchestra, each instrument or singer may be defined as an audio object with a specific spatial position. Further, object clustering may be performed for listener positions at several strategic positions in the concert hall.

An audio client may use a manifest file comprising one or more audio objects identifiers associated with separate atomic audio objects, audio clusters and multiplexed audio objects. Based on the metadata associated with the audio objects defined in the manifest file, the audio client is able to select audio objects depending on the spatial position and spatial orientation of a listener. For example, if a listener is positioned at the left side of the concert hall, then the audio client may select an object cluster for the whole right side of the orchestra, whereas the audio client may select individual audio objects from the left side of the orchestra. Thereafter, the audio client may render the audio objects and object clusters based on the direction and distance of those audio objects and object clusters relative to the listener.

In another example, a listener may trigger an audio-zoom function of the audio client enabling an audio client to zoom into a specific section of the orchestra. In such case, the audio client may retrieve individual atomic audio objects for the direction in which a listener zooms in, whereas it may retrieve other audio objects away from the zoom direction as aggregated audio objects. This way, the audio client may render the audio objects that is comparable with optical binoculars, that is at a larger angle from each other than the actual angle.

The embodiments in this disclosure may be used for audio applications with or without video. Hence, some embodiments, the audio data may be associated with video, e.g. a movie, while in other embodiment, the audio objects may be pure audio applications. For example in an audio play (e.g. the radio broadcast of "War of the Worlds"), the storyline may take the listener to different places, moving through an audible 3D world. Using a joystick, a user may navigate through the audible 3D world, e.g. "look around" and "zoom-in" (audio panning) in a specific direction. Depending on where and how deep the user is "looking", audio objects are either sent aggregated form (in one or more object clusters) or in de-aggregated form (in one or more single atomic audio objects) the audio client.

Transmission of the audio objects and audio object metadata may be realized in multiple ways, for example broadcast (tuning to selected broadcast channels on the basis of frequency, time slot, code multiplex), multicast (joining specific multicasts on the basis of IP multicast, eMBMS, IGMP), Unicast (RTP streams selected through RTSP), adaptive streaming (e.g. HTTP adaptive streaming schemes including MPEG-DASH, HLS, Smooth streaming) and combinations thereof (e.g. HbbTV which may use broadcast or multicast for the most requested audio objects and object clusters, and unicast or adaptive for the less requested ones). In all of these transmission schemes, the audio client may select audio objects based on a data structure, typically referred to as a manifest file 115, identifying the audio objects that the audio client can select.

Figure 2:
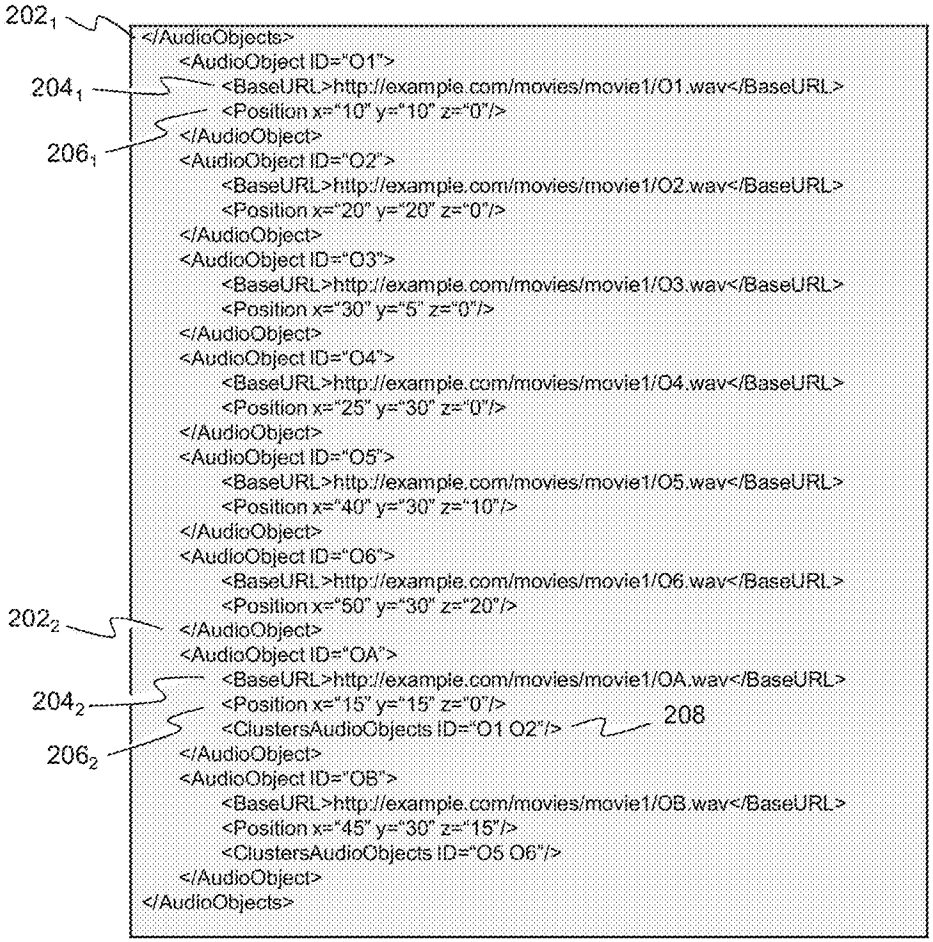
FIG. 2 depicts a schematic of part of a manifest file according to an embodiment of the invention.

FIG. 2 depicts an example of a manifest file according to an embodiment of the invention. In particular, FIG. 2 depicts (part of) a manifest file comprising audio object metadata as indicated by the <AudioObject> tag $202_1$. The audio object metadata may include audio object identifiers $204_1$, e.g. a resource locator, such as an uniform resource locator, URL, (as indicated by the <BaseURL> tag) or an uniform resource identifier, URI. The audio object identifier enables an audio client to request a server to transmit (stream) audio data and, optionally, audio metadata associated with the requested audio object to the audio client. The audio object metadata may further include audio object position information $206_1$ as indicated by the <Position> tag. The audio object position information may include coordinates of a coordination system, e.g. a 3D coordinate system such as a Cartesian, Euler, polar or spherical coordinate system.

The audio object metadata may further include aggregation information associated with the one or more aggregated audio objects, the aggregation information signalling the audio client apparatus which atomic audio objects are used for forming the one or more aggregated audio objects defined in the manifest file. For example, the clustering of multiple atomic audio objects may be signalled to the audio client using an <ClustersAudioObjects> tag 208, which identifies which audio objects are clustered inside this audio object cluster.

In this example, <ClustersAudioObjects> tag 208 signals the audio client that the audio object cluster is based on audio object 1 (ID="01") and audio object 2 ("ID="02"). Audio object $202_2$ thus defines an audio object cluster "OA" wherein the audio object identifier URL as defined by the <BaseURL> tag $202_4$ can be used to retrieve audio data associated with an audio file (in this case OA.wav).

If an <audio object> tag that defines an audio object in the manifest file does not comprise an <ClustersAudioObjects> tag or comprises an <ClustersAudioObjects> tag that is empty, than this may signal an audio client that the audio object is an atomic audio object. An audio object defined in the manifest file may further include audio object metadata (not shown in FIG. 2) including: information on the position, byte size, start time, play duration, dimensions, orientation, velocity and directionality of each audio object.

The audio client may be configured to select one or more audio objects on the basis of the audio object metadata in the manifest file and spatial listener information wherein the spatial listener information may comprise information regarding one or more listeners in audio space. The information may include a position and/or an orientation of the listener in audio space. Information regarding the listener position may include coordinates of the listener in audio space. The listener orientation may define a direction in which the listener is listening. The direction may be defined on the basis of an Euler angle coordinate system as explained with reference to FIG. 1B.

Moreover, an audio focus function may be defined including a combination of a listener orientation and an amplification factor indicating the loudness of audio data of an audio object listener orientation. This way a user is able to zoom into a desired position in the audio space. For example, a listener focus may be a listener orientation including an amplification of the audio data by a certain value (in decibels) in an area of certain degrees surrounding the listener orientation. This way, a listener will experience the audio associated audio object(s) that are within the listener focus louder. The effect of such audio zoom function may be comparable to that of an optical zoom function (as e.g. provided by binoculars). Controlling the loudness may e.g. include amplification and/or filtering of audio data of one or more audio objects in one or more parts of the audio spectrum.

Additionally, an audio client may further use capabilities information of the audio client and/or audio rendering system for selecting audio objects. For example, an audio client may only be capable of processing a maximum (of certain types of) audio objects (atomic audio objects, audio object clusters and/or multiplexed audio objects) or the spatial audio rendering capabilities are limited.

Based on the spatial listener information and the audio object position information an audio client may decide to retrieve and render all audio objects separately, e.g. {C(O1), C(O2), C(O3), C(O4), C(O5), C(O6)}. Alternatively, an audio client may decide to retrieve some object clusters instead of some separate audio objects, e.g. {C(O3), C(O4), C(O5), C(O6), C(OA)}.

FIG. 3 depicts a group of audio object according to an embodiment of the invention. In particular, FIG. 3 depicts an audio map 310 comprising atomic audio objects wherein some atomic audio objects may also be aggregated, e.g. clustered, and stored as an audio object cluster $C(O_A)$, $C(O_B)$ in a data storage 316. Additionally, the audio server may also store the audio data of separate atomic audio objects of the audio object clusters as an multiplexed audio object (here the notation $C(O_1,O_2)$ indicates a data file comprising audio data of objects 1 and 2 in multiplexed form). Similarly, $C(O_5,O_6)$ represents a data file with audio data of objects 5 and 6 in multiplexed form. Such multiplexed audio objects are advantageous as when an individual audio object is needed, then the most likely adjacent audio objects are needed as well. Hence, in that case, it is more efficient in terms of bandwidth, processing and signalling to request and transmit multiple related audio objects together in multiplexed form rather than separate audio objects in separate data containers.

The grouping as depicted in FIG. 3 may be signalled to the audio client on the basis of audio object metadata in the manifest file. FIG. 4 depicts parts of a manifest file for use by an audio client according to an embodiment of the invention. In this embodiment, audio data and, optionally, metadata of audio objects $O_1$ and $O_2$ may be multiplexed in a single MPEG2 TS stream identified by the name groupA.ts. In an embodiment, an audio object may be identified in a stream, e.g. an MPEG TS stream, on the basis of an identifier, e.g. a Packet Identifier (PID) as defined in the MPEG standard.

For example, in FIG. 4 the first <BaseURL PID> tag $\mathbf{402}_1$ may signal an audio client that the first audio object is formed as a first elementary stream in the MPEG stream that is identified by PID=1 and the second <BaseURL PID> tag $\mathbf{402}_2$ may signal an audio client that the first audio object is formed as a second elementary stream that is identified by PID=2. In this example, the second audio object $O_2$ is also made available separately (as an atomic audio object), so an audio client may decide to retrieve only atomic audio object $O_2$ and not audio object $O_1$.

In an embodiment, MPEG DASH SubRepresentation elements may be used to signal multiplexed audio objects to an audio client as e.g. described in the MPEG DASH standard, Part 1: Media presentation description and segment formats", ISO/IEC FDIS 23009-1:2013, par. 5.3.6.

Figure 5:
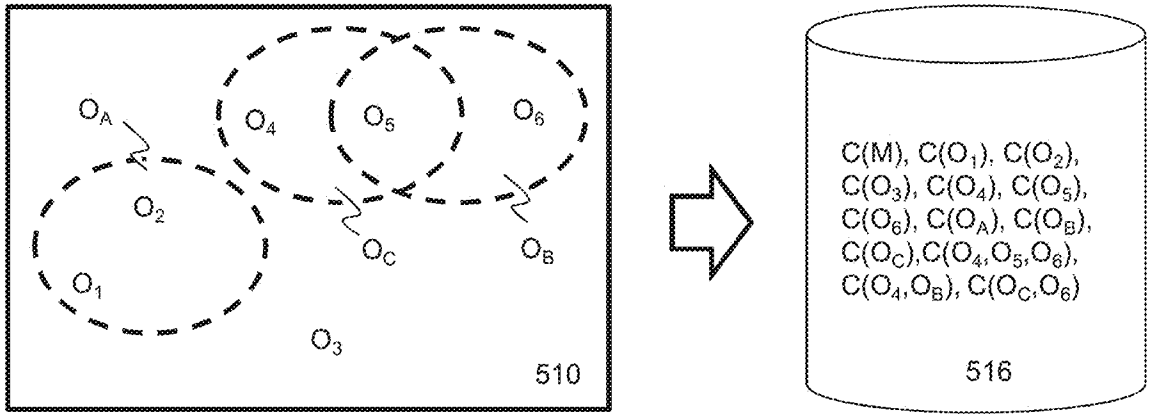
FIG. 5 depicts a group of audio object according to an embodiment of the invention.

FIG. 5 depicts aggregated audio objects according to various embodiments of the invention. As illustrated in the audio map 510 of FIG. 5, atomic audio objects may be used to form different types of aggregated audio. For example, in the example of FIG. 5 atomic audio object $O_5$ is used by an audio server to generate two different aggregated audio objects $O_C$ and $O_B$. The aggregation may be based on the positions of the atomic audio objects and spatial listener information.

In this example, atomic audio objects $O_5$ and $O_6$ are used in the formation of an aggregated audio object in the form of a clustered audio object $O_B$. Similarly, atomic audio objects $O_4$ and $O_5$ may be used to form a clustered audio object $O_C$. These aggregated audio objects may then be used to form aggregated audio objects of a higher level using for example multiplexing. For example, the audio data of aggregated audio objects $O_C$ and $O_B$ may be multiplexed with audio data of one or more atomic audio objects into aggregated audio objects of a higher aggregation level. The atomic audio object(s), the clustered audio object(s) and the multiplexed audio object(s) and/or audio object cluster(s) are then stored in suitable data containers in data storage 516. Depending on the spatial listener information that may include the position and orientation of a listener, and, optionally, the audio client capabilities information, the audio client may decide to retrieve different multiplexed audio objects, e.g. $C(O_4,O_5,O_6)$, $C(O_4,O_B)$ or $C(O_C,O_6)$.

Audio object may thus be aggregated hierarchically, e.g.: clustering of audio objects that are object clusters themselves; multiplexing audio data of different clustered audio objects; and, multiplexing of different multiplexed audio objects and/or clustered audio object. The technical benefits of these combinations may provide further flexibility and efficiency.

Figure 6:
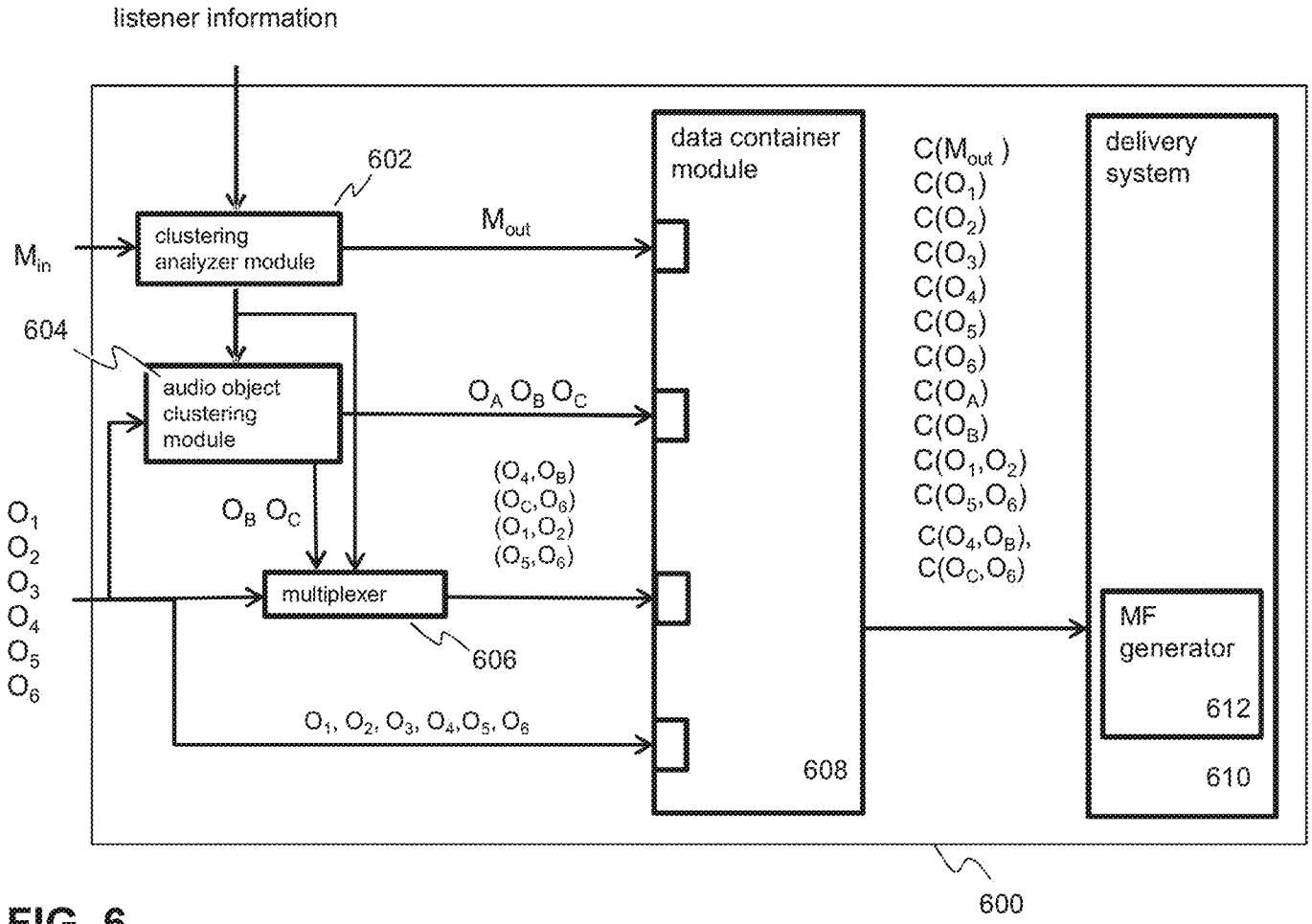
FIG. 6 depicts a schematic of an audio server according to an embodiment of the invention.

In an embodiment, an audio server may use the HTTP2 PUSH_PROMISE feature (as described in the HTTP2 standard section 6.6) in order to determine which audio objects an audio client may need (in the near future) and to send these audio objects to the audio client. In that FIG. 6 depicts a schematic of an audio server according to an embodiment of the invention. In particular, FIG. 6 depicts an audio server 600 that may comprise an aggregation analyser module 602, an audio object clustering module 604, an audio object multiplexer 606, a data container module 608, an audio delivery system 610 and a manifest file generator 612. Depending on the type of application, these functional modules may be implemented as hardware components, software components or a combination of hardware and software components.

The audio server may receive a set of atomic audio objects ($O_1$-$O_6$), metadata $M_{in}$ associated with the atomic audio objects and spatial listener information, which may comprise one or more listener locations and/or listener orientations. In an embodiment, the spatial listener information may be determined by a producer/director. In another embodiment, the spatial listener information may be transmitted as metadata to the audio client, e.g. in a separate stream or together with other data, e.g. video data in an MPEG stream or the like. In yet another element, the spatial listener information may be determined by the audio client or by a device associated with the audio client. For example, listener position information, such as the position and orientation of an audio listener, may be determined by sensors that are configured to provide sensor information to the audio client, e.g. an GPS sensor for determining a location and one or more magnetometers and/or one or more accelerometer for determining an orientation.

The aggregation analyser module 602 may be configured to analyse the metadata associated with the audio objects and determine on the basis of the spatial listener information, which aggregated audio objects need to be created. Using the input metadata $M_{in}$ of the atomic audio objects the aggregation analyser may create output metadata $M_{out}$, including metadata associated with the created aggregated audio objects.

The audio object clustering module 604 may be configured to create object clusters based on the instructions from the aggregation analyser module and the audio objects. The audio object clustering module may include decoding of audio data of the individual audio objects, merging the decoded audio data of different audio object together according to a predetermined audio data processing scheme, e.g. a scheme as described in WO2014099285, and re-encoding the resulting audio data as clustered audio data for a clustered audio object. In an embodiment, the encoding and formatting of the encoded data into a data container may be performed in a single step.

Similarly, the audio object multiplexer 606 may be configured to create multiplexed audio objects based on the instructions from the aggregation analyser module and the audio objects.

In an embodiment, the data container module may be configured to put the atomic and aggregated audio objects and associated metadata into appropriate data containers. Examples of data containers may be the MPEG2 Transport Stream (.ts) data container and ISOBMFF (.mp4) data container, which may comprise multiplexed audio objects, as well as separate atomic audio objects, clustered audio objects and associated metadata. The metadata may be formatted on the basis of a (simple) file format, e.g. a file with XML or JSON. Atomic audio objects and aggregated audio objects may be formatted on the basis of a (simple) file format, including but not limited to: .3gp; .aac; .act; .aiff; .amr; .au; .awb; .dct; .dss; .dvf; .flac; .gsm; .iklax; .ivs; .m4a; .m4p; .mmf; .mp3; .mpc; .msv; .ogg; .oga; .opus; .ra; .rm; .raw; .sin; .tta; .vox; .wav; .webm; .wma; .wv.

The audio delivery system 610 is configured to store the generated audio objects and to make them available for delivery using e.g. broadcast, multicast, unicast, adaptive, hybrid or any other suitable data transmission scheme. A manifest file generator 612 may generate a data structure referred to as a manifest file (MF) comprising audio object metadata including audio object identifiers or information for determining audio object identifiers for signalling an audio client which audio objects are available for retrieval by an audio client. The audio object identifiers may include retrieval information (e.g. tuning frequency, time slot, IP multicast address, IP unicast address, RTSP URI, HTTP URI or other) for enabling an audio client to determine where audio objects and associated metadata can be retrieved. In an embodiment, at least part of the audio object metadata may be provided separately from the audio objects to the audio client.

Figure 7:
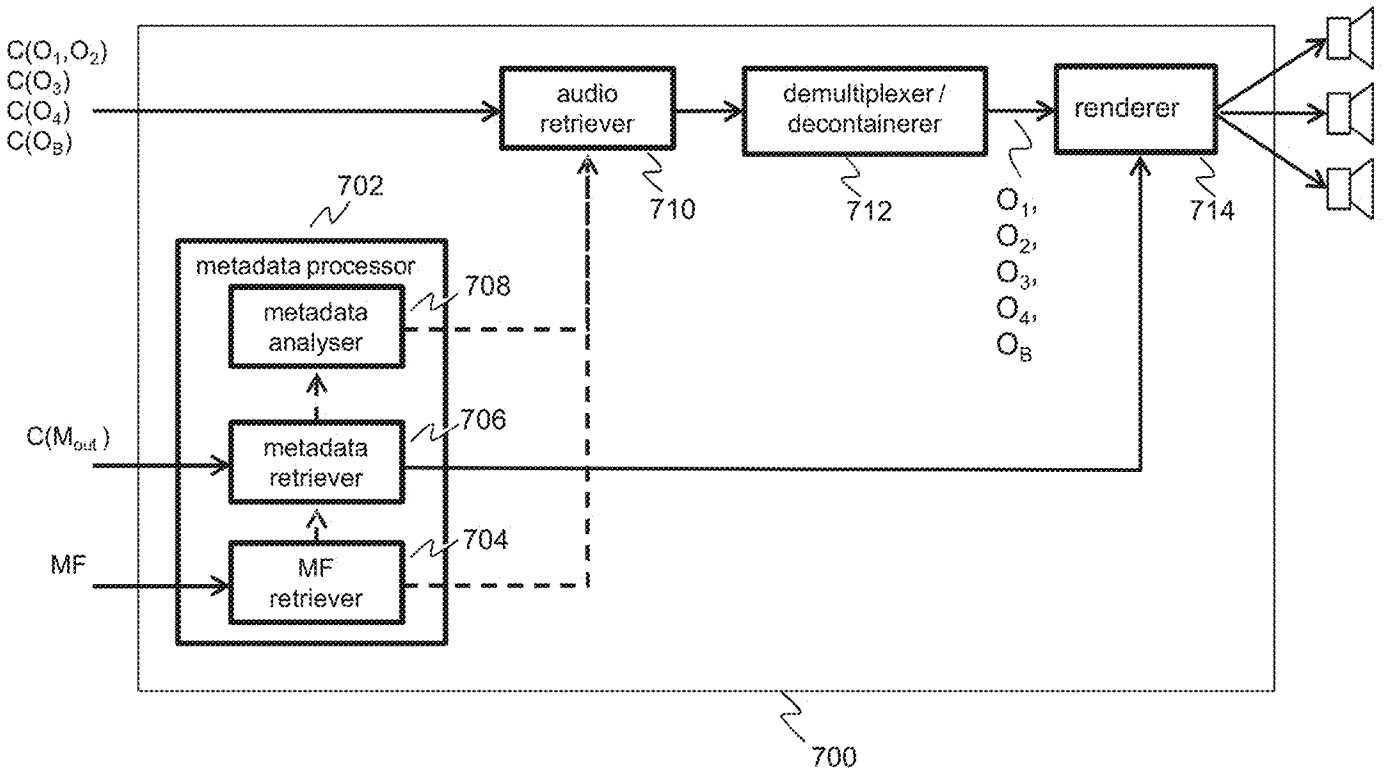
FIG. 7 depicts a schematic of an audio client according to an embodiment of the invention.

FIG. 7 depicts a schematic of an audio client (also referred to as client device or client apparatus) according to an embodiment of the invention. In particular, FIG. 7 depicts an example of an audio client comprising a number of functional modules, including a metadata processor 702, audio retriever module 710, demultiplexer/decontainer module 712 and an audio rendering module 714. The metadata processor may further comprise a MF retriever module 704, metadata retriever module 706 and a metadata analyser module 708. Depending on the type of application, these functional modules may be implemented as hardware components, software components or a combination of hardware and software components.

The inputs of the audio client may include an input for receiving audio objects (the output from the server side), as well as an input for receiving information associated with the loudspeaker system, e.g. the loudspeaker configuration information and/or loudspeaker capabilities information. The loudspeaker configuration may be a standard one, for example a Dolby 5.1, 7.1 or 22.2 configuration, an audio bar in a TV set, a stereo head phone or a proprietary configuration.

The audio client may further comprise an input for receiving spatial listener information, which may include information on the listener location (e.g. the location of the listener in the audio space defined in accordance with a suitable coordinate system).

The spatial listener location may be determined in two aspects, namely relative to the loudspeaker configuration and relative in the audio scene. The former may be static (listener in the centre of a 5.1, 7.1 or 22.2 set-up) or dynamic (e.g. head phones where the listener can turn his head). The latter may be static (director location) or dynamic (audio zoom, walk around) as well. In the dynamic cases, a continuous or at least a regular (periodic) update of the spatial listener information is required (possibly using sensors). Scenarios including dynamic spatial listener information such as time-dependent listener location and orientation include virtual reality and augmented reality applications in which a mobile device such as a head mounted device (HMD) or the like may comprise sensors, e.g. a GPS sensor and one or more accelerometers, for determining an audio listener location and/or orientation in audio space.

The metadata processor 702 may be configured to handle the manifest file and audio object metadata. The metadata processor may comprise a manifest file retriever module 704, a metadata retriever module 706 and a metadata analyser module 708. The manifest file retriever module may be configured to retrieve a manifest file, typically after a selection or action by the user. The metadata retriever module 706 may be configured to retrieve the audio object metadata based on the information provided in the manifest file. The metadata analyser module is configured to analyse the audio metadata and select which audio objects, object clusters and multiplexed audio objects need to be retrieved, based on the spatial listener information (e.g. position and orientation) and loudspeaker configuration. In an embodiment, there may be more than one listener and the metadata analyser module may be configured to perform the analysis for each listener position.

The audio retriever module 710 may be configured to retrieve the data containers with audio objects, atomic audio objects and aggregated audio objects, as selected by the metadata analyser module, using audio object metadata in the manifest file.

The demultiplexer/decontainerer module 712 may be configured to perform demultiplexing and decontainering (e.g. extraction of the audio data and metadata from the data container) of the audio objects into separate audio objects.

Further, a rendering module 714 may be configured to decode the audio data of the audio objects so that the decoded audio data can be rendered by the loudspeaker system on the basis of the spatial listener information and information associated with the loudspeaker configuration.

Figure 8:
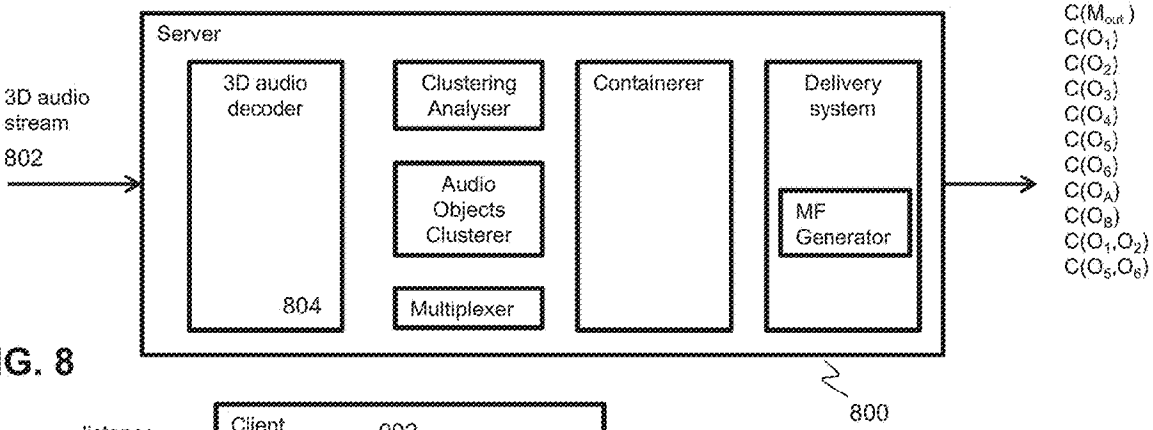
FIG. 8 depicts a schematic of an audio server according to another embodiment of the invention.

FIG. 8 depicts a schematic of an audio server according to an embodiment of the invention. In this embodiment, audio objects and metadata may be provided to the audio server 800 in one or more MPEG 3D audio streams 802. Such audio stream may be defined in the 3D audio MPEG standard (MPEG 3DA, "Information technology—High efficiency coding and media delivery in heterogeneous environments—Part 3: 3D audio", ISO/IEC DIS 23008-3). In that case, an 3D audio decoder 804 may be used to obtain the individual audio objects and their metadata which are subsequently processed by the audio server in a similar way as described by reference to FIG. 6.

Figure 9:
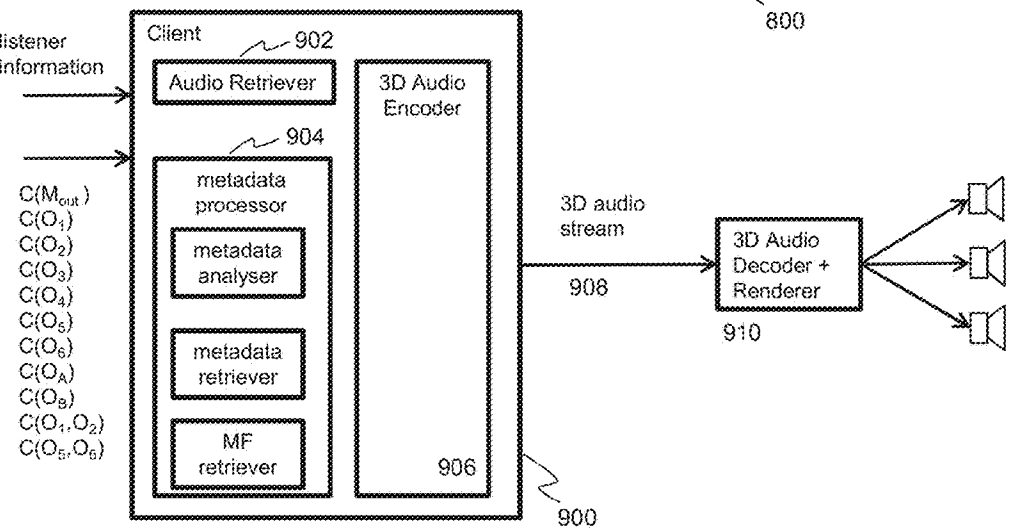
FIG. 9 depicts a schematic of an audio client according to another embodiment of the invention.

FIG. 9 depicts a schematic of an audio client (a client apparatus) according to an embodiment of the invention. In this embodiment an embodiment, the audio client 900 may comprise an audio retriever 902 and a metadata processor 904 that are similar to the audio retriever and metadata processor of the client described with reference to FIG. 6. The audio client may receive or may be provided with spatial listener information, e.g. information about the listener position and/or listener orientation.

Once the audio objects are retrieved by the audio retriever on the basis of the on the basis of a manifest file, the audio data may be (re)encoded by an 3D audio encoder 906 into a 3D audio stream 908 is subsequently decoded and rendered by a separate 3D audio decoder and rendering system 910.

Figure 10:
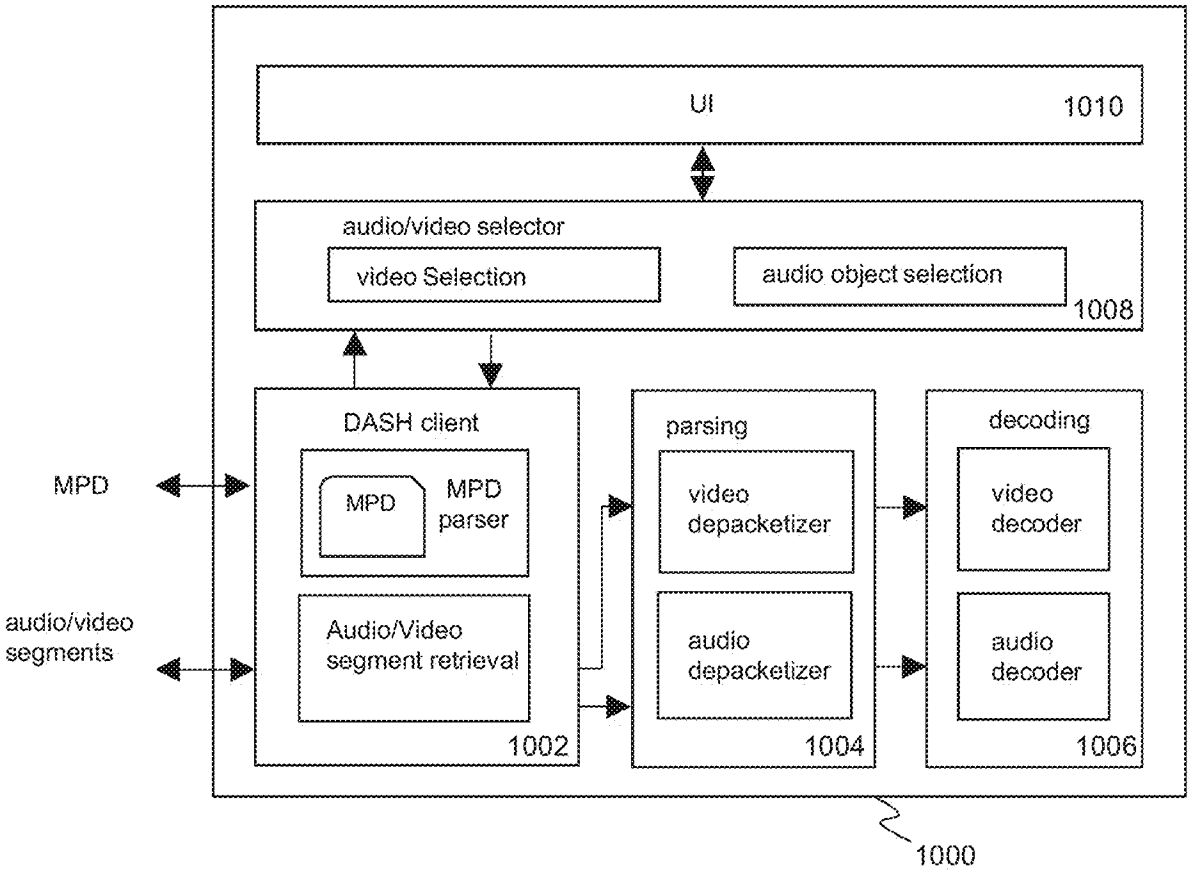
FIG. 10 depicts a schematic of a client according to an embodiment of the invention.

FIG. 10 depicts a schematic of an audio/video (AV) client apparatus according to an embodiment of the invention. In particular, FIG. 10 depicts an AV client apparatus 1000 comprising a client device 1002 for Dynamic Adaptive Streaming over HTTP (in short a DASH client device), that is configured to process audio and video data on the basis of a DASH manifest file. In MPEG-DASH a manifest file may be referred to as a Media Presentation Description (MPD). In an embodiment, the DASH client may be a client according to MPEG DASH ISO/IEC 23009-1 standard or a derivative thereof.

The AV client apparatus may comprise an MPEG DASH client 1002 comprising an MPD parser 1004 that is configured to retrieve and process, e.g. parse, MPDs. Further, the DASH client may comprise an AV segment retrieval module comprising an HTTP interface for requesting a media server audio and video segments on the basis of the information in the MPD. In particular, in an embodiment, the MPD may identify audio objects (atomic audio objects and aggregated audio objects such as clustered audio object and multiplexed audio objects) and associated audio object metadata as described above with reference to FIG. 1-9.

Further, the MPD may comprise audio object metadata, including audio object identifiers for enabling the client to request audio segments comprising selected audio objects and audio object location information that signals the client about the location in the audio space of audio objects identified in the MPD.

An audio/video selector module 1008 may be configured to select audio segments and video segments (typically audio and video files of 2-10 second length) on the basis of the information provided by the MPD parser. In an embodiment, the selection of audio and video may be triggered by a user interacting with a user interface (UI) 1010 of the client device.

The information on the selected audio objects may be provided to the audio/video segment retrieval module. After receiving the requested segments, the segments may be buffered, parsed and audio and video data may be extracted from the data containers in the received segments. Thereafter, the audio and video data may be decoded and rendered.

In an embodiment, an audio object may be represented by an Adaptation Set in an MPD. An Adaptation Set may comprise of a set of (audio) Representations containing different versions of the same of similar audio content (e.g. audio associated with different languages of spoken subtitles). This way, an audio object may be made available in multiple variants, e.g. different quality and/or bandwidth variants, so that the audio system can adaptively switch back to a lower audio quality and/or bandwidth version when needed (e.g. due to network traffic or (temporarily) bandwidth constrains).

Audio objects are associated with position information, e.g. a position or an area in audio space based on a suitable coordinate system. In an embodiment, a 3D Euler or Cartesian coordinate system may be used as the coordinate system for the audio space. In other embodiments, a spherical, a cylindrical, or a 2D polar coordinate system may be used. In another embodiment, the audio object may associated with spatial dimensions and/or a particular shape e.g. a plane, line, sphere, cylinder, circle, ellipsoid, etc.

Table 1 below describes an exemplary embodiment, introducing the properties of an audio object as a SupplementalProperty or EssentialProperty in MPEG-DASH. In this embodiment audio objects may be positioned at specific locations in audio space defined by a 3D coordinate system as signalled by the information in the MPD to an audio client.

In an embodiment, a predetermined spatial relation descriptor (SRD), an audio SRD, may be used to signal spatial information on the audio objects in the MPD to an audio client. For example, in an embodiment, an SRD SupplementalProperty or EssentialProperty schemeldUri, e.g. schemeldUri "urn:mpeg:dash:srda:2017", may be used for signalling a client device that the network supports processing of audio objects in audio space in accordance to embodiments described this disclosure.

In an embodiment, an audio SRD may include audio object metadata, including information identifying to which audio objects the audio SRD applies, e.g. a source_id attribute. In a further embodiment, the audio object metadata in the SRD may include audio object position information regarding the position of an audio object in audio space (using e.g. object_x, object_y, object_z attributes).

In a further embodiment, the audio object metadata may include a spatial_set_id attribute. This parameter may be used to functionally group a number of related audio objects, and, optionally, spatial video content such as video tile streams (which may be defined as Adaptation Sets in an MPEG-DASH MPD). The audio object metadata may further include information about the relation between spatial objects, e.g. audio objects and, optionally spatial video (e.g. tiled video content) that have the same spatial_set_id.

In an embodiment, the audio object metadata may comprise a spatial set type attribute for indicating the type of relation between spatial objects in the MPD (wherein spatial objects may include audio objects and, optionally, spatial video objects). For example, in an embodiment, the spatial set type may be set to a first value, e.g. "0", in order to signal an audio client that audio objects with the same spatial_set_id may relate to a particular group of atomic audio objects, e.g. a group of atomic audio objects that positioned close to each other in audio space, for which also an aggregated version or a partly aggregated version exists. In another embodiment, the spatial set type may be set to a second value, e.g. "1", in order to signal an audio client that audio objects may be related to spatial video. For example, a group of functionally related spatial audio and video may be defined by setting the spatial set id value in the audio SRD of audio objects to the same value as the spatial set id value in the video SRD of video objects.

In yet a further embodiment, the audio object metadata in the SRD may include aggregation information, e.g. aggregation_level and aggregated_objects attributes, for signalling an audio client whether an audio object is an aggregated audio object and—if so—which audio objects are used for forming the aggregated audio object so that the audio client is able determine the level of aggregation the audio object is associated with. For example, a multiplexed audio object formed on the basis of one or more atomic audio objects and a clustered audio object (which again is formed on the basis of a number of atomic audio objects) may be regarded as an aggregated audio object of level 2.

Table 1 provides an exemplary description of audio SRD attributes:

TABLE 1 attributes of the SRD scheme for audio objects

| EssentialProperty@value or SupplementalProperty@value parameter | Description |
|---|---|
| source_id | non-negative integer in decimal representation providing the identifier for the source of the content |

TABLE 1-continued attributes of the SRD scheme for audio objects

| EssentialProperty@value or SupplementalProperty@value parameter | Description |
|---|---|
| object_x | integer in decimal representation expressing the horizontal position of the Audio Object in arbitrary units |
| object_y | integer in decimal representation expressing the vertical position of the Audio Object in arbitrary units |
| object_z | integer in decimal representation expressing the depth position of the Audio Object in arbitrary units |
| spatial_set_id | non-negative integer in decimal representation providing an identifier for a group of audio objects. |
| spatial set type | non-negative integer in decimal representation defining a functional relation between audio objects or audio objects and video objects in the MPD that have the same spatial set id. |
| aggregation_level | non-negative integer in decimal representation expressing the aggregation level of the Audio Object. Level greater than 0 means that the Audio Object is the aggregation of other Audio Objects. |
| aggregated_objects | conditional mandatory comma-separated list of AdaptationSet@id (i.e Audio Objects) that the Audio Object aggregates. When present, the preceding aggregation_level parameter shall be greater than 0. |

In an embodiment, the audio SRD scheme for audio objects may be used in an MPD as shown in table 2, which illustrates a non-limiting example of an MPD for playout of segmented audio using MPEG DASH. As shown in this table, the MPD may identify spatial audio, wherein the audio space associated with the spatial audio content may be defined by an audio SRD.

TABLE 2 an example of an MPD supporting spatial SRDs for audio.

```
<?xml version="1.0" encoding="UTF-8"?>
<MPD
  xmlns="urn:mpeg:dash:schema:mpd:2011"
  type="static"
  mediaPresentationDuration="PT10S"
  minBufferTime="PT1S"
  profiles="urn:mpeg:dash:profile:isoff-on-demand:2011">
  <ProgramInformation>
    <Title>Example of a DASH Media Presentation Description using Spatial Relationship
Descriptions for signalling spatial audio </Title>
  </ProgramInformation>
  <BaseURL>http://example.com/movies/movie1/</BaseURL>
  <Period>
<!— spatial audio -->
<!— spatial audio objects of aggregation level 0 -->
<!— spatial audio object – O1 -->
    <AdaptationSet id="O1" mimeType="audio/way" segmentAlignment="true"
subsegmentAlignment="true" subsegmentStartsWithSAP="1">
      <SupplementalProperty schemeIdUri="urn:mpeg:dash:srda:2017" value="0,10,10,0,0,0"/>
      <Representation bandwidth="1055223" startWithSAP="1">
        <BaseURL>O1.way</BaseURL>
```

TABLE 2-continued an example of an MPD supporting spatial SRDs for audio.

```
        </Representation>
      </AdaptationSet>
      <!— spatial audio object – O2 -->
      <AdaptationSet id="O2" mimeType="audio/way" segmentAlignment="true"
subsegmentAlignment="true" subsegmentStartsWithSAP="1">
        <SupplementalProperty schemeIdUri="urn:mpeg:dash:srda:2017" value="0,20,20,0,0,0"/>
        <Representation bandwidth="1055223" startWithSAP="1">
          <BaseURL>O2.way</BaseURL>
        </Representation>
      </AdaptationSet>
      <!— spatial audio object – O3 -->
      <AdaptationSet id="O3" mimeType="audio/way" segmentAlignment="true"
subsegmentAlignment="true" subsegmentStartsWithSAP="1">
        <SupplementalProperty schemeIdUri="urn:mpeg:dash:srda:2017" value="0,30,5,0,0,0"/>
        <Representation bandwidth="1055223" startWithSAP="1">
          <BaseURL>O3.way</BaseURL>
        </Representation>
      </AdaptationSet>
      <!— spatial audio object – O4 -->
      <AdaptationSet id="O4" mimeType="audio/way" segmentAlignment="true"
subsegmentAlignment="true" subsegmentStartsWithSAP="1">
        <SupplementalProperty schemeIdUri="urn:mpeg:dash:srda:2017" value="0,25,30,0,0,0"/>
        <Representation bandwidth="1055223" startWithSAP="1">
          <BaseURL>O4.way</BaseURL>
        </Representation>
      </AdaptationSet>
      <!— spatial audio object – O5 -->
      <AdaptationSet id="O5" mimeType="audio/way" segmentAlignment="true"
subsegmentAlignment="true" subsegmentStartsWithSAP="1">
        <SupplementalProperty schemeIdUri="urn:mpeg:dash:srda:2017" value="0,40,30,10,0,0"/>
        <Representation bandwidth="1055223" startWithSAP="1">
          <BaseURL>O5.way</BaseURL>
        </Representation>
      </AdaptationSet>
      <!—spatial audio object – O6 -->
      <AdaptationSet id="O6" mimeType="audio/way" segmentAlignment="true"
subsegmentAlignment="true" subsegmentStartsWithSAP="1">
        <SupplementalProperty schemeIdUri="urn:mpeg:dash:srda:2017" value="0,50,30,20,0,0"/>
        <Representation bandwidth="1055223" startWithSAP="1">
          <BaseURL>O6.way</BaseURL>
        </Representation>
      </AdaptationSet>
      <!- spatial audio objects of aggregation level 1 -->
      <!— spatial audio object – OA -->
      <AdaptationSet id="OA" mimeType="audio/way" segmentAlignment="true"
subsegmentAlignment="true" subsegmentStartsWithSAP="1">
        <SupplementalProperty schemeIdUri="urn:mpeg:dash:srda:2017"
value="0,15,15,0,0,0,1,O1,O2"/>
        <Representation bandwidth="1055223" startWithSAP="1">
          <BaseURL>OA.way</BaseURL>
        </Representation>
      </AdaptationSet>
      <!— spatial audio object – OB -->
      <AdaptationSet id="O6" mimeType="audio/way" segmentAlignment="true"
subsegmentAlignment="true" subsegmentStartsWithSAP="1">
        <SupplementalProperty schemeIdUri="urn:mpeg:dash:srda:2017"
value="0,45,30,15,0,0,1,O5,O6"/>
        <Representation bandwidth="1055223" startWithSAP="1">
          <BaseURL>OB.way</BaseURL>
        </Representation>
      </AdaptationSet>
    </Period>
</MPD>
<!— spatial audio object – OC -->
      <AdaptationSet id="OC" mimeType="audio/way" segmentAlignment="true"
subsegmentAlignment="true" subsegmentStartsWithSAP="1">
        <SupplementalProperty schemeIdUri="urn:mpeg:dash:srda:2017"
value="0,0,0,0,0,0,2,O1,O2,O3,O4,O5,O6"/>
        <Representation bandwidth="1055223" startWithSAP="1">
          <BaseURL>OB.way</BaseURL>
        </Representation>
      </AdaptationSet>
    </Period>
</MPD>
```

The MPD separately defines atomic audio objects, e.g. six atomic audio objects O1-O6, and aggregated audio objects, e.g. aggregated audio objects OA, OB, OC, and associated with metadata, e.g. audio SRDs, so that the audio objects can also be individually accessed by the client.

The audio space defined by the audio SRD may be used to define a listener location and a listener direction. Similarly, a video space defined by the video SRD may be used to define a viewer position and a viewer direction. Typically, audio and video space are coupled as the listener position/orientation and the viewer position/direction (the direction in which the viewer is watching) may coincide or at least correlate. Hence, a change of the position of the listener/viewer in the video space may cause a change in the position of the listener/viewer in the audio space.

In a further embodiment, the audio SRD scheme for audio objects may be used in an MPD as shown in table 3, which illustrates a non-limiting example of an MPD for playout of segmented audio and video using MPEG DASH. As shown in this table, the MPD may identify spatial video and spatial audio, wherein the audio space associated with the spatial audio content may be defined by an audio SRD and the video space associated with the spatial video may be defined by an video SRD.

An example of spatial video is spatially segmented (tiled) video content, wherein the video content may include one or more tiled versions (e.g. resolution versions) of (part of) a panorama video. Examples of such tiled video content, in this case HEVC-tiled video content, are described in WO2015/197815 and WO2015/197818 which are hereby incorporated by reference into this application.

In an example, video frames of a source video, e.g. a wide-view panorama video, may be divided (tiled) in subregions (video tiles). The video frames may be divided into a grid (array) of video tiles, wherein each video tiles has a predetermined position in the video frames of the source video.

Video content associated with such subregion may be individually requested by a client and rendered on the basis of metadata information in a manifest file, e.g. an MPEG DASH MPD. Content, e.g. in the form of video data, associated with one or more video tiles may be transmitted as one or more tile streams to the client.

Hence, the tile streams may define spatial objects, in this particular case spatial video objects, in the form of video content associated with spatial information as defined in the video SRD. In an embodiment, video frames of different resolution or quality versions of the source video may be spatially divided in grids of different tile sizes. The set of tile streams associated with a particular spatial grid of video tiles and a particular resolution and/or quality may be referred to as a spatial video set.

The spatial relation between a source video or source videos e.g. a high-resolution panorama video, and the spatial video sets that are based on the source video(s) may be described using a spatial relation descriptor (SRD) as known from MPEG-DASH standard ISO/IEC 23009-1:2015-AMD2 Annex H.

The SRD SupplementalProperty or EssentialProperty schemeIdUri "urn:mpeg:dash:srd:2014" may be used as a data structure for signalling the position information associated with the spatial video content to the client device. The value parameter associated with the SRD may include (in sequence) a source_id, object_x, object_y, object_width, object_height, total_width, total_height and a spatial_set_id. These parameters may define the size of a spatial video object (a video tile) and the position of a video tile in the tile grid. Here, the object_x and object_y attributes in the SRD define a 2D video space.

The spatial set id allows grouping of spatial objects (e.g. video tiles) that have a certain relation with each other in a similar way as described above with reference the audio objects. For example, in an embodiment, a group of tile streams associated with a particular video resolution and grid size may be grouped together using the spatial_set_id.

TABLE 3 an example of an MPD supporting spatial SRDs for audio and tiled 2D video.

```
<?xml version="1.0" encoding="UTF-8"?>
<MPD
  xmlns="urn:mpeg:dash:schema:mpd:2011"
  type="static"
  mediaPresentationDuration="PT10S"
  minBufferTime="PT1S"
  profiles="urn:mpeg:dash:profile:isoff-on-demand:2011">
  <ProgramInformation>
    <Title>Example of a DASH Media Presentation Description using Spatial Relationship
Descriptions for signalling spatial audio and tiled 2D content </Title>
  </ProgramInformation>
  <BaseURL>http://example.com/movies/movie1/</BaseURL>
  <Period>
<!—Spatial video-->
<!—Full Panorama in 7680 by 4320 pixels-->
  <AdaptationSet [...]>
      <EssentialProperty schemeIdUri="urn:mpeg:dash:srd:2014" value="1, 0, 0, 0, 0, 0, 0, 0"/>
      <Representation width=0 height=0 id="panorama-8K" bandwidth="5000000">
        <BaseURL>panorama_8K-base.mp4</BaseURL>
      </Representation>
    </AdaptationSet>
<!— 2x2 video tiles-->
<AdaptationSet [...]>
      <SupplementalProperty schemeIdUri="urn:mpeg:dash:srd:2014" value="1, 0, 0, 3840, 2160,
7680 , 4320, 1"/>
      <Representation id="panorama-8K-tile1" bandwidth="512000" depedencyId="panorama-8K">
        <BaseURL>panorama_8k-tile1.mp4</BaseURL>
        <SegmentBase indexRange="7632" />
      </Representation>
    </AdaptationSet>
```

TABLE 3-continued an example of an MPD supporting spatial SRDs for audio and tiled 2D video.

```
<AdaptationSet [...]>
        <SupplementalProperty schemeIdUri="urn:mpeg:dash:srd:2014" value="1, 3840, 0, 3840, 2160,
7680 , 4320, 2"/>
        <Representation id="panorama-8K-tile2" bandwidth="512000" depedencyId="panorama-8K">
            <BaseURL>panorama_8k-tile2.mp4</BaseURL>
            <SegmentBase indexRange="7632" />
        </Representation>
    </AdaptationSet>
<AdaptationSet [...]>
        <SupplementalProperty schemeIdUri="urn:mpeg:dash:srd:2014" value="1, 0, 2160, 3840, 2160,
7680 , 4320, 1"/>
        <Representation id="panorama-8K-tile3" bandwidth="512000" depedencyId="panorama-8K">
            <BaseURL>panorama_8k-tile3.mp4</BaseURL>
            <SegmentBase indexRange="7632" />
        </Representation>
    </AdaptationSet>
<AdaptationSet [...]>
        <SupplementalProperty schemeIdUri="urn:mpeg:dash:srd:2014" value="1, 3840, 2160, 3840,
2160, 7680 , 4320, 2"/>
        <Representation id="panorama-8K-tile4" bandwidth="512000" depedencyId="panorama-8K">
            <BaseURL>panorama_8k-tile4.mp4</BaseURL>
            <SegmentBase indexRange="7632" />
        </Representation>
    </AdaptationSet>
<!— spatial audio -->
<!— spatial audio objects of aggregation level 0 -->
<!— spatial audio object – O1 -->
    <AdaptationSet id="O1" mimeType="audio/way" segmentAlignment="true"
subsegmentAlignment="true" subsegmentStartsWithSAP="1">
        <SupplementalProperty schemeIdUri="urn:mpeg:dash:srda:2017" value="1,10,10,0,1,1"/>
        <Representation bandwidth="1055223" startWithSAP="1">
            <BaseURL>O1.way</BaseURL>
        </Representation>
    </AdaptationSet>
    <!— spatial audio object – O2 -->
    <AdaptationSet id="O2" mimeType="audio/way" segmentAlignment="true"
subsegmentAlignment="true" subsegmentStartsWithSAP="1">
        <SupplementalProperty schemeIdUri="urn:mpeg:dash:srda:2017" value="1,445,3000,555,1,1"/>
        <Representation bandwidth="1055223" startWithSAP="1">
            <BaseURL>O2.way</BaseURL>
        </Representation>
    </AdaptationSet>
    <!— spatial audio object – O3 -->
    <AdaptationSet id="O3" mimeType="audio/way" segmentAlignment="true"
subsegmentAlignment="true" subsegmentStartsWithSAP="1">
        <SupplementalProperty schemeIdUri="urn:mpeg:dash:srda:2017" value="1,2244,2500,400,1,1"/>
        <Representation bandwidth="1055223" startWithSAP="1">
            <BaseURL>O3.way</BaseURL>
        </Representation>
    </AdaptationSet>
    <!— spatial audio object – O4 -->
    <AdaptationSet id="O4" mimeType="audio/way" segmentAlignment="true"
subsegmentAlignment="true" subsegmentStartsWithSAP="1">
        <SupplementalProperty schemeIdUri="urn:mpeg:dash:srda:2017" value="1,5600,200,750,2,1"/>
        <Representation bandwidth="1055223" startWithSAP="1">
            <BaseURL>O4.way</BaseURL>
        </Representation>
    </AdaptationSet>
    <!— spatial audio object – O5 -->
    <AdaptationSet id="O5" mimeType="audio/way" segmentAlignment="true"
subsegmentAlignment="true" subsegmentStartsWithSAP="1">
        <SupplementalProperty schemeIdUri="urn:mpeg:dash:srda:2017" value="1,7000,6000,40,2,1"/>
        <Representation bandwidth="1055223" startWithSAP="1">
            <BaseURL>O5.way</BaseURL>
        </Representation>
    </AdaptationSet>
    <!—spatial audio object – O6 -->
    <AdaptationSet id="O6" mimeType="audio/way" segmentAlignment="true"
subsegmentAlignment="true" subsegmentStartsWithSAP="1">
        <SupplementalProperty schemeIdUri="urn:mpeg:dash:srda:2017" value="1,6500,5000,500,2,1"/>
        <Representation bandwidth="1055223" startWithSAP="1">
            <BaseURL>O6.way</BaseURL>
        </Representation>
    </AdaptationSet>
    <!- spatial audio objects of aggregation level 1 -->
    <!— spatial audio object – OA -->
    <AdaptationSet id="OA" mimeType="audio/way" segmentAlignment="true"
subsegmentAlignment="true" subsegmentStartsWithSAP="1">
```

TABLE 3-continued an example of an MPD supporting spatial SRDs for audio and tiled 2D video.

```
        <SupplementalProperty schemeIdUri="urn:mpeg:dash:srda:2017"
value="1,2000,2000,500,1,1,1,O1,O2"/>
        <Representation bandwidth="1055223" startWithSAP="1">
          <BaseURL>OA.way</BaseURL>
        </Representation>
      </AdaptationSet>
      <!— spatial audio object – OB -->
      <AdaptationSet id="O6" mimeType="audio/way" segmentAlignment="true"
subsegmentAlignment="true" subsegmentStartsWithSAP="1">
        <SupplementalProperty schemeIdUri="urn:mpeg:dash:srda:2017"
value="1,6000,6000,100,2,1,1,O5,O6"/>
        <Representation bandwidth="1055223" startWithSAP="1">
          <BaseURL>OB.way</BaseURL>
        </Representation>
      </AdaptationSet>
    </Period>
</MPD>
<!— spatial audio object – OC -->
      <AdaptationSet id="OC" mimeType="audio/way" segmentAlignment="true"
subsegmentAlignment="true" subsegmentStartsWithSAP="1">
        <SupplementalProperty schemeIdUri="urn:mpeg:dash:srda:2017"
value="1,0,0,0,0,1,1,O1,O2,O3,O4,O5,O6"/>
        <Representation bandwidth="1055223" startWithSAP="1">
          <BaseURL>OB.way</BaseURL>
        </Representation>
      </AdaptationSet>
    </Period>
</MPD>
```

As shown in table 3, the MPD comprises MPD elements (Adaptation Sets) defining spatial video and audio, which may be rendered by the client device.

In particular, the MPD may describe a source video, in this case an non-tiled full panorama video, and tiled video content that is created on the basis of the source video, in this case a tiled version (2×2 tiles) of the panorama video. Hence, separate video streams, each representing a temporal sequence of video frames of a subregion of the video frames of the source video, may be defined. Such subregion may be referred to as a video tile. Video metadata in the MPD may be used to signal information about the tile streams to the client device. For example, in an embodiment, the video metadata may include tile stream identifiers, e.g. URLs and/or URIs or information for forming such identifiers (e.g. a template). Tile stream identifiers may be used for identifying tile streams associated with one or more one source videos. Further, tile position information associated with a tile stream may be used to describe the position of the video tile in the video frames of the source video. In an embodiment, the spatial relation between the tile streams and the source video may be described using a video SRD.

Further, similar to the example in table 2, the MPD separately defines atomic audio objects, e.g. six atomic audio objects O1-O6, and aggregated audio objects, e.g. aggregated audio objects OA, OB, OC, and associated with metadata, e.g. audio SRDs, so that the audio objects can also be individually accessed by the client.

The audio space defined by the audio SRD may be used to define a listener location and a listener direction. Similarly, a video space defined by the video SRD may be used to define a viewer position and a viewer direction. Typically, audio and video space are coupled as the listener position/orientation and the viewer position/direction (the direction in which the viewer is watching) may coincide or at least correlate. Hence, a change of the position of the listener/viewer in the video space may cause a change in the position of the listener/viewer in the audio space.

The information in the MPD may allow a user, a viewer/listener, to interact with the video content using e.g. a touch screen based user interface or a gesture-based user interface. For example, a user may interact with a (panorama) video in order "zoom" into an area of the panorama video as if the viewer "moves" towards a certain area in the video picture. Such zooming action may provide the 2D video space a "third dimension". Similarly, a user may interact with a video using a "panning" action as if the viewer changes its viewing direction.

The client device may use the MPD to request tile streams associated with the user interaction, e.g. zooming or panning. For example, in case of a zooming interaction, a user may select a particular subregion of the panorama video wherein the video content of the selected subregions corresponds to certain tile streams of a spatial video set. The client device may then use the information in the MPD to request the tile streams associated with the selected subregion, process (e.g. decode) the video data of the requested tile streams and form video frames comprising the content of the selected subregion.

Due to the coupling of the video and audio space, the zooming action may change the audio experience of the listener. For example, when watching a panorama video distance between the atomic audio objects and the viewer/listener may be large so that the listener is not able to spatially distinguish between spatial audio objects. Hence, in that case, the audio associated with the panorama video may be efficiently rendered on the basis of a single or a few aggregated audio objects, e.g. a clustered audio object comprising audio data that is based on a large number of individual (atomic) audio objects.

In contrast, when zooming into a particular subregion of the video (i.e. a particular direction in a video space), the distance between the viewer/listener and one or more audio objects associated with the particular subregion may be small so that the viewer/listener may spatially distinguish between different atomic audio objects. Hence, in that case, the audio may be rendered on the basis of one or more atomic audio objects and, optionally, one or more aggregated audio objects.

In order to allow a client to efficiently select audio objects on the basis of spatial video that is rendered, the MPD may include information linking spatial video to spatial audio. For example, spatial video objects, such as tile streams, may be linked with spatial audio objects using the spatial_set_id attribute in the audio SRD. To that end, a spatial set type attribute in the audio SRD may be used to signal the client device that the spatial_set_id attribute in the audio and video SRD may be used to link spatial video to spatial audio.

For example in the MPD of table 3, the panorama video and an audio object representing a fully aggregated version (aggregation level 1) of all individual atomic audio objects O1-O6 may be linked using a spatial audio set of value "0". Similarly, video tiles of the left side of the panorama may be linked to a set of audio objects (both atomic and aggregated) using a spatial audio set of value "1"; the video tiles of the right side of the panorama may be linked to a set of audio objects using a spatial audio set of value "2".

The video space and the audio space use the same coordinate system for defining positions. For example, the x,y plane in the 2D video space (as defined by the video SRD) may coincide with the x,y plane of the 3D audio space (as defined by the audio SRD).

Hence, when the client device switches from rendering video on the basis of a first spatial video set to rendering video on the basis of a second spatial video set, the client device may use the spatial_set_id associated with the spatial video sets, e.g. the second spatial video set, in order to efficiently identify a set of audio objects in the MPD from which the client can select audio objects for rendering with the video. This scheme is particular advantageous when the amount of audio objects is large.

Instead of 2D tiled video, other types of spatial video, e.g. 3D spatial video for VR applications may be used. In that case, video objects may be associated with a 3D coordinate system defining a video space. For example SRD parameters in the value field may in that case include object_x, object_y, object_z and spatial_set_id attributes.

In some embodiments, the MPD may comprise an indicator (not shown) that an audio object is dynamic, i.e. moves in time. In that case, on an embodiment, the audio object position information (e.g. the audio-object coordinate provided in the MPD) may be regarded as the location of the audio object at the start time of an audio segment. Information about the movement of an audio object, e.g. coordinates, velocity, direction, etc.) may be included in the audio file itself, or may be provided in a separate file.

In an embodiment an ISOBMFF file may comprise dynamic audio object coordinates wherein the audio object coordinates are transported in metadata segments to the client.

The coordinate system may use a reference_width and reference_height, corresponding to the width and height of a reference screen for locating audio objects. The coordinate system may also include a reference_depth. The origin_x, origin_y and origin_z coordinates of the audio object are relative to reference_width, reference_height, and reference_depth, respectively. The audio object may be block-shaped with a width, height and depth. Linear interpolation may be used to determine the location of an audio object at a time between coordinate samples.

The 3D Cartesian coordinates sample entry provides spatial information related to the referenced track expressed in a three-dimensional coordinate system, in this example a 3D Cartesian coordination system. SampleEntry is a template defined in ISOBMFF ISO/IEC 14496-12 for inserting metadata into an ISOBMFF file. So the ISOBMFF file carriers both audio object, as well as the (moving) coordinates for each audio object. The 3D Cartesian coordinates sample entry may be defined as follows:

```
aligned(8) class 3DCartesianCoordinatesSampleEntry
  extends MetadataSampleEntry ('3dcc') {
  unsigned int(16)          reference_width;
  unsigned int(16)          reference_height;
  unsigned int(16)          reference_depth;
}
```

wherein the parameters reference_width, reference_height and reference_depth define respectively the width and height of the reference rectangular space in which all coordinates (top_left_x, top_left_y, width and height) are computed. For instance, these fields allow associating a coordinate metadata track with audio tracks of different resolutions but representing the same audio source.

The 3D Cartesian coordinates sample may have the following syntax:

```
aligned(8) class 3DCartesianCoordinatesSample( ){
  signed int(16) origin_x;
  signed int(16) origin_y;
  signed int(16) origin_z;
  unsigned int(16)                width;
  unsigned int(16)                height;
  unsigned int(16)                depth;
  unsigned int(1) interpolate;
  unsigned int(7) reserved;
}
```

Sync samples for ROI metadata tracks are samples for which the interpolate value is 0.

Here, the parameters origin_x, origin_y and origin_z define respectively the horizontal, vertical and depth coordinates of the origin corner (closest corner from the coordinate system origin) of the cubic region associated with the media sample of the referenced track. Further, the parameters width, height and depth define respectively the width, height and depth of the cubic region associated with the media sample of the referenced track.

The parameter interpolate indicates the continuity in time of the successive samples. When true, the application may linearly interpolate values of the coordinates between the previous sample and the current sample. When false, no interpolation of values between the previous and the current samples is possible.

Figure 11:
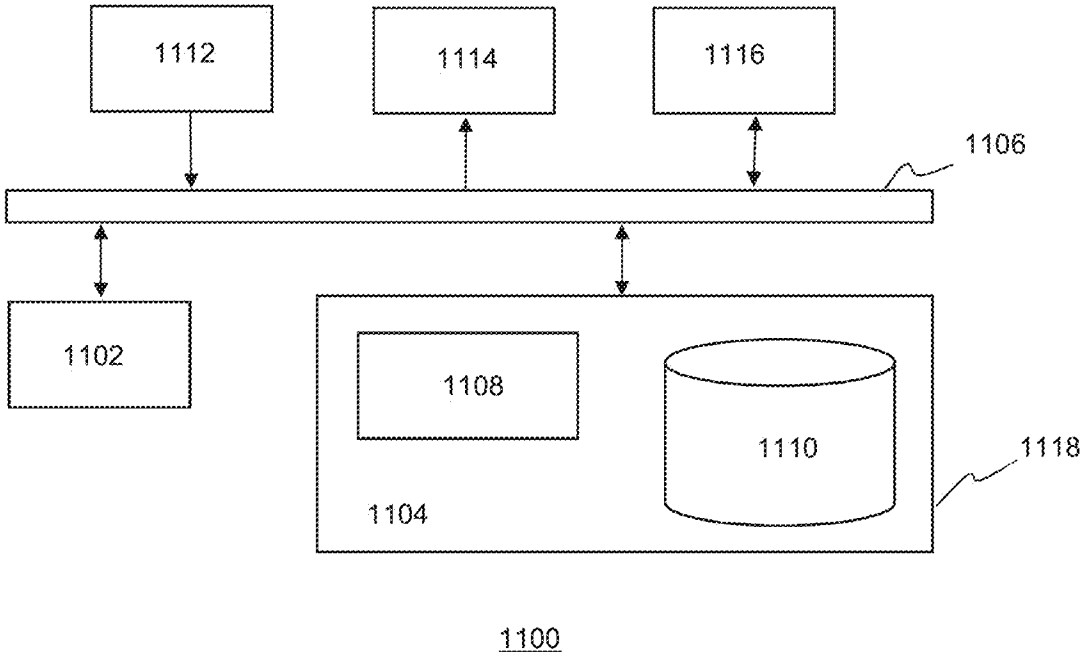
FIG. 11 depicts a block diagram illustrating an exemplary data processing system that may be used in as described in this disclosure.

FIG. 11 is a block diagram illustrating an exemplary data processing system that may be used in as described in this disclosure. Data processing system 1100 may include at least one processor 1102 coupled to memory elements 1104 through a system bus 1106. As such, the data processing system may store program code within memory elements 1104. Further, processor 1102 may execute the program code accessed from memory elements 1104 via system bus 1106. In one aspect, data processing system may be implemented as a computer that is suitable for storing and/or executing program code. It should be appreciated, however, that data processing system 1100 may be implemented in the form of any system including a processor and memory that is capable of performing the functions described within this specification.

Memory elements 1104 may include one or more physical memory devices such as, for example, local memory 1108 and one or more bulk storage devices 1110. Local memory may refer to random access memory or other non-persistent memory device(s) generally used during actual execution of the program code. A bulk storage device may be implemented as a hard drive or other persistent data storage device. The processing system 1100 may also include one or more cache memories (not shown) that provide temporary storage of at least some program code in order to reduce the number of times program code must be retrieved from bulk storage device 1110 during execution.

Input/output (I/O) devices depicted as input device 1112 and output device 1114 optionally can be coupled to the data processing system. Examples of input device may include, but are not limited to, for example, a keyboard, a pointing device such as a mouse, or the like. Examples of output device may include, but are not limited to, for example, a monitor or display, speakers, or the like. Input device and/or output device may be coupled to data processing system either directly or through intervening I/O controllers. A network adapter 1116 may also be coupled to data processing system to enable it to become coupled to other systems, computer systems, remote network devices, and/or remote storage devices through intervening private or public networks. The network adapter may comprise a data receiver for receiving data that is transmitted by said systems, devices and/or networks to said data and a data transmitter for transmitting data to said systems, devices and/or networks. Modems, cable modems, and Ethernet cards are examples of different types of network adapter that may be used with data processing system 1150.

As pictured in FIG. 11, memory elements 1104 may store an application 1118. It should be appreciated that data processing system 1100 may further execute an operating system (not shown) that can facilitate execution of the application. Application, being implemented in the form of executable program code, can be executed by data processing system 1100, e.g., by processor 1102. Responsive to executing application, data processing system may be configured to perform one or more operations to be described herein in further detail.

In one aspect, for example, data processing system 1100 may represent a client data processing system. In that case, application 1118 may represent a client application that, when executed, configures data processing system 1100 to perform the various functions described herein with reference to a "client". Examples of a client can include, but are not limited to, a personal computer, a portable computer, a mobile phone, or the like.

In another aspect, data processing system may represent a server. For example, data processing system may represent an (HTTP) server in which case application 1118, when executed, may configure data processing system to perform (HTTP) server operations. In another aspect, data processing system may represent a module, unit or function as referred to in this specification.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A method for processing audio objects by a client apparatus comprising:

the client apparatus determining spatial listener information, the spatial listener information including one or more listener positions and/or listener orientations of one or more listeners in a three dimensional (3D) space, the 3D space defining an audio space;

the client apparatus receiving a manifest file comprising audio object metadata, including audio object identifiers for identifying audio objects, the audio objects being atomic audio objects and one or more aggregated audio objects, wherein an atomic audio object comprises audio data associated with a position in the audio space and an aggregated audio object comprises aggregated audio data of at least a part of the atomic audio objects defined in the manifest file, wherein each of the audio object identifiers comprises at least part of a URI;

the client apparatus selecting one or more audio object identifiers on the basis of the spatial listener information, and on the basis of audio object position information defined in the manifest file, the audio object position information comprising positions in the audio space of the atomic audio objects defined in the manifest file; and the client apparatus using the one or more selected audio object identifiers for requesting transmission of audio data and audio object metadata of the one or more selected audio objects to the client apparatus.

2. The according to claim 1 wherein selecting the one or more audio object identifiers comprises:

selecting an audio object identifier of an aggregated audio object comprising aggregated audio data of two or more atomic audio objects, if at least one or more distances between the two or more atomic audio objects relative to at least one of the one or more listener positions has passed a predetermined threshold value.

3. The method according to claim 1, wherein the audio object metadata further includes aggregation information associated with the one or more aggregated audio objects, the aggregation information indicating to the client apparatus which atomic audio objects are used for forming the one or more aggregated audio objects defined in the manifest file, and wherein the one or more aggregated audio objects further include: at least one clustered audio object comprising audio data formed on the basis of merging audio data of different atomic audio objects in accordance with a predetermined data processing scheme, and/or a multiplexed audio object formed one the basis of multiplexing audio data of different atomic audio objects.

4. The method according to claim 1, wherein the manifest file further comprises video metadata, the video metadata defining spatial video content associated with the audio objects, the video metadata including:

tile stream identifiers for identifying tile streams associated with one or more one source videos, a tile stream comprising a temporal sequence of video frames of a subregion of the video frames of the source video, the subregion defining a video tile; and tile position information.

5. The method according to claim 4 further comprising:

the client apparatus using the video metadata for selecting and requesting transmission of one or more tile streams to the client apparatus; and the client apparatus determining the spatial listener information on the basis of the tile position information associated with at least part of the requested tile streams.

6. The method according to claim 1, wherein requesting transmission of the audio data and audio object metadata of the one or more selected audio objects is based on an HTTP adaptive streaming protocol.

7. The method according to claim 6, wherein the manifest file further comprises one or more Adaptation Sets, an Adaptation Set being associated with one or more audio objects and/or spatial video content and a plurality of different representation of the one or more audio objects and/or spatial video content, preferably the different representation of the one or more audio objects and/or spatial video content including quality representations of an audio and/or video content and/or one or more bandwidth representations of an audio and/or video content.

8. The method according to claim 6 wherein the manifest file comprises:

one or more audio spatial relation descriptors (SRDs), an audio (SRD) comprising one or more SRD parameters for defining a position of at least one audio object in audio space, a SRD further comprising an aggregation indicator for indicating to the client apparatus that an audio object is an aggregated audio object and/or aggregation information for indicating to the client apparatus which audio objects identified through the audio object metadata of the manifest file are used for forming an aggregated audio object.

9. The method according to claim 6, wherein the manifest file further comprises:

one or more video spatial relation descriptors (SRDs), a video SRD comprising one or more SRD parameters for defining a position of at least one spatial video content in video space, and tile position information associated with a tile stream for defining the position of the video tile in the video frames of the source video.

10. The method according to claim 6, wherein the manifest file further comprises:

one or more audio spatial relation descriptors (SRDs), an audio SRD comprising one or more SRD parameters for defining a position of at least one audio object in audio space, a SRD further comprising an aggregation indicator for indicating to the client apparatus that an audio object is an aggregated audio object and/or aggregation information for indicating to the client apparatus which audio objects identified through the audio object metadata of the manifest file are used for forming an aggregated audio object;

one or more video SRDs, a video SRD comprising one or more SRD parameters for defining a position of at least one spatial video content in video space, and tile position information associated with a tile stream for defining the position of the video tile in the video frames of the source video; and information for correlating audio objects with the spatial video content, the further information including a spatial group identifier.

11. The method according to claim 1, further comprising:

receiving audio data of requested audio objects;

rendering the audio data into audio signals for a speaker system on the basis of the audio object metadata.

12. The method according to claim 1, wherein receiving or determining spatial listener information comprises:

receiving or determining spatial listener information on the basis of sensor information, the sensor information being generated by one or more sensors configured to determine a position and/or orientation of a listener, the one or more sensors being at least one of: one or more accelerometers and/or magnetic sensors for determining an orientation of a listener, or one position sensor for determining a position of a listener.

13. The method according to claim 1, wherein the spatial listener information is static, the static spatial listener information including one or more predetermined spatial listening positions and/or listener orientations, at least part of the static spatial listener information being defined in the manifest file.

14. The method according to claim 1, wherein the spatial listener information is dynamic, the dynamic spatial listener information being transmitted to the audio client apparatus, and wherein the manifest file comprises one or more resource identifiers for identifying a server that is configured to transmit the dynamic spatial listener information to the client apparatus.

15. The method of claim 1, wherein the URI comprises a URL.

16. A client apparatus comprising:

a processor;

memory; and computer readable instructions stored in the memory that, when executed by the processor, cause the client apparatus to carry out operations including:

determining spatial listener information, the spatial listener information including one or more listener positions and/or listener orientations of one or more listeners in a three dimensional (3D) space, the 3D space defining an audio space;

receiving a manifest file comprising audio object metadata, including audio object identifiers for identifying audio objects, the audio objects being atomic audio objects and one or more aggregated audio objects, wherein an atomic audio object comprises audio data associated with a position in the audio space and an aggregated audio object comprises aggregated audio data of at least a part of the atomic audio objects defined in the manifest file, wherein each of the audio object identifiers comprises at least part of a URI;

selecting one or more audio object identifiers one the basis of the spatial listener information, and on the basis of audio object position information defined in the manifest file, the audio object position information comprising positions in the audio space of the atomic audio objects defined in the manifest file; and, using the one or more selected audio object identifiers for requesting transmission of audio data and audio object metadata of the one or more selected audio objects to the client apparatus.

17. The client apparatus of claim 16, wherein the URI comprises a URL.

18. A non-transitory computer-readable medium for storing instructions that, when executed by a processor of a client apparatus, cause the client apparatus to carry out operations including:

determining spatial listener information, the spatial listener information including one or more listener positions and/or listener orientations of one or more listeners in a three dimensional (3D) space, the 3D space defining an audio space;

receiving a manifest file comprising audio object metadata, including audio object identifiers for identifying audio objects, the audio objects being atomic audio objects and one or more aggregated audio objects, wherein an atomic audio object comprises audio data associated with a position in the audio space and an aggregated audio object comprises aggregated audio data of at least a part of the atomic audio objects defined in the manifest file, wherein each of the audio object identifiers comprises at least part of a URI;

selecting one or more audio object identifiers one the basis of the spatial listener information, and on the basis of audio object position information defined in the manifest file, the audio object position information comprising positions in the audio space of the atomic audio objects defined in the manifest file; and using the one or more selected audio object identifiers for requesting transmission of audio data and audio object metadata of the one or more selected audio objects to the client apparatus.

19. The non-transitory computer-readable storage media according to claim 18, wherein the instructions further include instructions for defining data structure comprising audio object metadata, the audio object metadata including:

audio object identifiers for indicating a client apparatus atomic audio objects and one or more aggregated audio objects that can be requested, wherein an atomic audio object comprises audio data associated with a position in the audio space and an aggregated audio object comprises aggregated audio data of at least a part of the atomic audio objects defined in the manifest file;

audio object position information for indicating to the client apparatus the positions in the audio space of the atomic audio objects defined in the manifest file, the audio object position information being included in one or more audio spatial relation descriptors (SRDs), an audio SRD comprising one or more SRD parameters for defining the position of at least one audio object in audio space; and aggregation information associated with the one or more aggregated audio objects, the aggregation information indicating to the client apparatus which atomic audio objects are used for forming the one or more aggregated audio objects defined in the manifest file, wherein the aggregation information is included in one or more audio SRDs, the aggregation information including an aggregation indicator for signalling the client apparatus that an audio object is an aggregated audio object.

20. The non-transitory computer-readable storage media according to claim 19, wherein the instructions further include instructions for defining data structure comprising video object metadata, the video metadata including:

tile stream identifiers for identifying tile streams associated with one or more one source videos, a tile stream comprising a temporal sequence of video frames of a subregion of the video frames of the source video, the subregion defining a video tile, wherein tile position information is included in one or more video SRDs, a video SRD comprising one or more SRD parameters for defining the position of at least one spatial video content in video space;

and wherein the one or more audio and/or video SRD parameters include information for correlating audio objects with spatial video content, he information including a spatial group identifier.

21. The non-transitory computer-readable medium of claim 18, wherein the URI comprises a URL.

* * * * *